US006604919B1

(12) United States Patent
Nishio et al.

(10) Patent No.: US 6,604,919 B1
(45) Date of Patent: Aug. 12, 2003

(54) FLUID APPARATUS SUCH AS A PUMP OR AN ACCUMULATOR

(75) Inventors: Kiyoshi Nishio, Sanda (JP); Hitoshi Kawamura, Sanda (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 126 days.

(21) Appl. No.: 09/868,940

(22) PCT Filed: Nov. 20, 2000

(86) PCT No.: PCT/JP00/08161

§ 371 (c)(1),
(2), (4) Date: Jul. 18, 2001

(87) PCT Pub. No.: WO01/40653

PCT Pub. Date: Jun. 7, 2001

(30) Foreign Application Priority Data

Nov. 29, 1999 (JP) ..... 11-337564

(51) Int. Cl.[7] ..... F04B 45/02
(52) U.S. Cl. ..... 417/472
(58) Field of Search ..... 417/472, 412, 417/534, 540

(56) References Cited

U.S. PATENT DOCUMENTS 6,322,338 B1 * 11/2001 Nishio ..... 417/540
6,345,963 B1 * 2/2002 Thomin et al. ..... 417/412
6,364,640 B1 * 4/2002 Nishio et al. ..... 417/540
6,488,487 B2 * 12/2002 Minato ..... 417/540

FOREIGN PATENT DOCUMENTS

| | | |
|---|---|---|
| JP | 53-130602 | 3/1952 |
| JP | 61-262531 | 11/1986 |
| JP | 62-99687 | 5/1987 |
| JP | 3-179184 | 8/1991 |
| JP | 3-504152 | 9/1991 |
| JP | 4-76876 | 4/1992 |
| JP | 4-121462 | 4/1992 |
| JP | 6-17752 | 1/1994 |
| JP | 6-17006 | 5/1994 |
| JP | 8-159016 | 6/1996 |
| JP | 10-47234 | 2/1998 |
| JP | 10-196521 | 7/1998 |
| JP | 10-303155 | 11/1998 |
| JP | 11-107925 | 4/1999 |

* cited by examiner

*Primary Examiner*—Teresa Walberg
*Assistant Examiner*—Vinod D. Patel
(74) *Attorney, Agent, or Firm*—Jones, Tullar & Cooper, P.C.

(57) ABSTRACT

A fluid device capable of preventing sediment from stagnating and accumulating in a liquid chamber of a pump when a transfer liquid containing sediment such as slurry is used, wherein a suction port (18) and a delivery port (19) and a diaphragm (7) are installed in the pump main body (1), the suction port (18) is provided in the side face of a projected tip part of the pump main body, and a suction liquid is sprayed toward a circular wall inside a liquid chamber (9), thus causing swirl flow, whereby the inside of the liquid chamber is agitated.

6 Claims, 18 Drawing Sheets

FLUID APPARATUS SUCH AS A PUMP OR AN ACCUMULATOR

TECHNICAL FIELD

The present invention relates to a fluid apparatus such as a bellows type pump, a diaphragm type pump, or an accumulator.

BACKGROUND ART

As a pump for circulating and transporting chemical liquid in various processes such as washing of surfaces of ICs or liquid crystal display devices in a semiconductor producing apparatus, used is a bellows type pump or a diaphragm type pump in which no particles are generated as a result of the pumping operation (for example, Japanese Patent Application Laying-Open No. 3-179184). In a pump of this kind, pulsations are produced by reciprocal motion due to extension and contraction of the bellows. In order to reduce the pulsations, therefore, also an accumulator is used (for example, Japanese Patent Application Laying-Open Nos. 6-17752 and 10-196521).

In such a bellows type pump, a diaphragm type pump, and an accumulator, in order to prevent the performance of processing such as washing from being lowered, it is requested to reduce staying of the transported liquid and always supply fresh liquid. In a bellows type pump, an accumulator, or the like, particularly, a suction port of the pump or an inflow port of the accumulator is opened so as to eject sucked liquid or inflowing liquid into a liquid chamber in a direction parallel to the axial direction (direction of reciprocal motion) of a respective bellows. Therefore, the liquid easily stays in an extending and contracting portion of the respective bellows, and contamination tends to occur. In the case where liquid containing a sedimenting material such as slurry of silica or the like is used as a polishing solution for Chemical Mechanical Polishing (CMP) of a semiconductor wafer, a hard disk which is to be incorporated into a computer, and the like, the sedimenting material easily sediments and aggregates in a pump or an accumulator to affect the life of the pump or the accumulator.

The invention has been conducted in order to solve the problems. It is an object of the invention to provide a fluid apparatus in which staying of liquid in a pump or an accumulator is reduced to enable fresh liquid to be always supplied, and, even in the case where liquid containing a sedimenting material such as slurry is used, the sedimenting material can be prevented from sedimenting and aggregating inside the pump or the accumulator.

Disclosure of Invention

The fluid apparatus of the invention is a fluid apparatus configured by a reciprocating pump in which a diaphragm that reciprocally moves in an axial direction, such as a bellows or a diaphragm is disposed in a pump body so as to form a liquid chamber with respect to an inner wall of the pump body, a suction port and a discharge port are disposed in the inner wall of the pump body facing the liquid chamber, and a stroke of sucking liquid from the suction port into the liquid chamber, and a stroke of discharging the liquid in the liquid chamber from the discharge port are alternately performed by reciprocal motion of the diaphragm. In the fluid apparatus, the suction port is disposed so as to eject the sucked liquid toward a circumferential wall which is in the liquid chamber and in a direction different from the axial direction.

In this case, the suction port may be disposed in a side face of a protruding tip end portion of a suction check valve which is fixed so as to protrude into the liquid chamber from the inner wall of the pump body facing the liquid chamber.

In the thus configured reciprocating pump, since the suction port is disposed so as to eject the sucked liquid toward the circumferential wall in the liquid chamber, the sucked liquid ejected from the suction port produces a swirling flow along the inner periphery of the liquid chamber, and the interior of the liquid chamber is stirred by the swirling flow. Therefore, staying of liquid in the liquid chamber is reduced to enable fresh liquid to be always supplied, and, even in the case where liquid containing a sedimenting material such as slurry is used, the sedimenting material can be prevented from sedimenting and aggregating in the liquid chamber.

The fluid apparatus of the other invention is a fluid apparatus configured by an accumulator in which a diaphragm that reciprocally moves in an axial direction, such as a bellows or a diaphragm is disposed in an accumulator body so as to form a liquid chamber inside the diaphragm and an air chamber outside the diaphragm, an inflow port and an outflow port are disposed in an inner wall of the accumulator body facing the liquid chamber, and a liquid pressure in the liquid chamber balances with an air pressure in the air chamber. In the fluid apparatus, the inflow port is disposed so as to eject inflowing liquid toward a circumferential wall which is in the liquid chamber and in a direction different from the axial direction.

In this case, the inflow port may be disposed in a side face of a protruding tip end portion of a discharge check valve which is fixed so as to protrude into the liquid chamber from the inner wall of the accumulator body facing the liquid chamber.

In the thus configured accumulator, since the inflow port is disposed so as to eject the inflowing liquid toward the circumferential wall in the liquid chamber, the inflowing liquid ejected from the inflow port produces a swirling flow along the inner periphery of the liquid chamber, and the interior of the liquid chamber is stirred by the swirling flow. Therefore, staying of liquid in the liquid chamber is reduced to enable fresh liquid to be always supplied, and, even in the case where liquid containing a sedimenting material such as slurry is used, the sedimenting material can be prevented from sedimenting and aggregating in the liquid chamber.

BEST MODE FOR CARRYING OUT THE INVENTION

An embodiment of the fluid apparatus according to the invention will be described with reference to FIGS. 1 to 9. The fluid apparatus of the embodiment is configured by combining a reciprocating pump P with an accumulator A which reduces pulsations of the pump.

Figure 1:
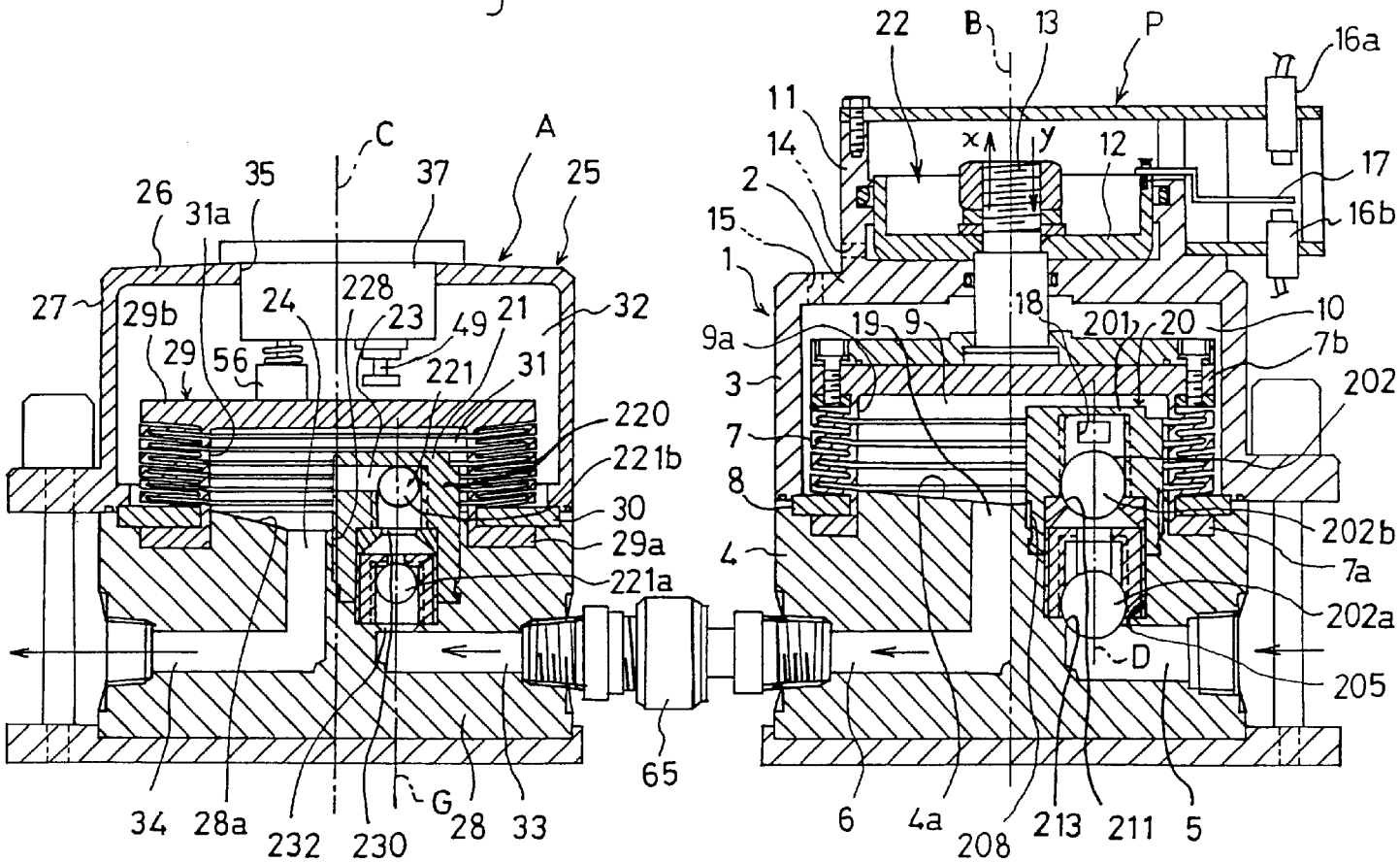
FIG. 1 is a longitudinal sectional front view of a reciprocating pump and an accumulator of a fluid apparatus.

Referring to FIG. 1, the pump body 1 of the reciprocating pump P has: a circular cylindrical casing 3 in which an upper end is closed by an upper wall 2; and a bottom wall member 4 which airtightly closes an open lower end of the casing 3. A liquid inflow passage 5 and a liquid outflow passage 6 are formed in the bottom wall member 4.

A bottomed circular cylindrical diaphragm 7 which is configured by a bellows, and which is extendingly and contractingly deformable in a direction of the axis B is placed in the casing 3 with setting the axis B vertical. The diaphragm 7 is molded by a fluororesin which has excellent heat and chemical resistances, such as PTFE (polytetrafluoroethylene) or PFA (perphloroalkoxy). A lower opening peripheral edge 7*a* of the diaphragm is airtightly pressingly fixed to an upper side face of the bottom wall member 4 by an annular fixing plate 8, whereby the inner space of the pump body 1 is partitioned into a liquid chamber 9 inside the diaphragm 7, and an air chamber 10 outside the diaphragm 7.

Figure 2A:
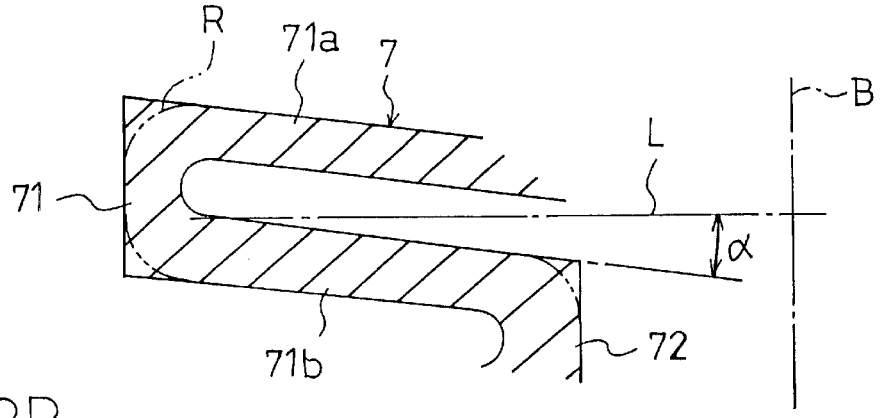
FIG. 2A is an enlarged section view of an extending and contracting portion of a diaphragm of the reciprocating pump.
Figure 2B:
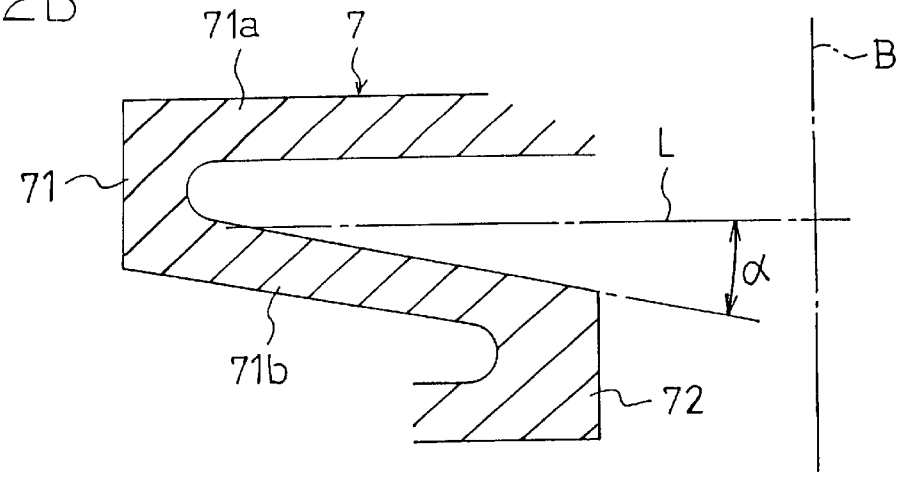
FIG. 2B is an enlarged section view showing another modification of the extending and contracting portion of the diaphragm of the reciprocating pump.
Figure 2C:
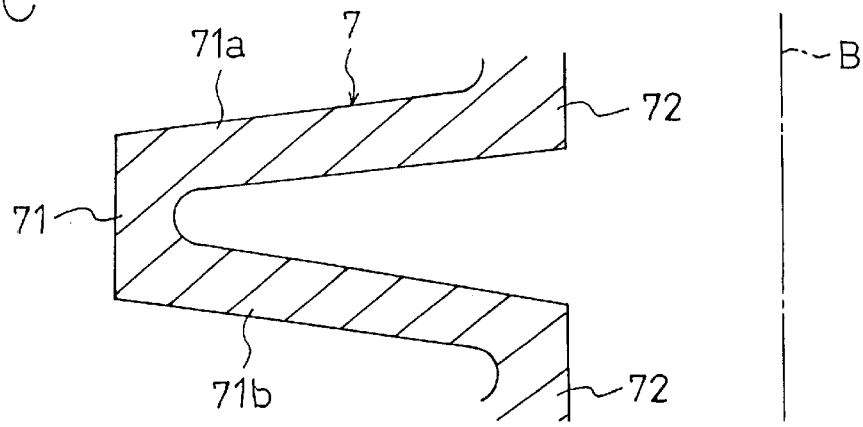
FIG. 2C is an enlarged section view showing a further modification of the extending and contracting portion of the diaphragm of the reciprocating pump.

Referring to FIGS. 2A, 2B, and 2C, in the diaphragm 7, an extending and contracting portion which is configured by forming ridge-like folds 71 and valley-like folds 72 in a vertically alternate and continuous manner is formed into a shape in which the lower one of upper and lower lamella portions 71*a* and 71*b* of each of the ridge-like folds 71, or the lower lamella portion 71*b* is downward inclined as moving toward the axis B, not only in an extending state but also in a contracting state as shown in FIGS. 2A, 2B, and 2C. In the contracting state of each of the ridge-like folds 71, the inclination angle a of the lower lamella portion 71*b*, i.e., the angle a formed by a horizontal line L perpendicular to the axis B is 1 to 45°, and more preferably 5 to 15°. However, the upper lamella portion 71*a* of each ridge-like fold 71 may be arbitrarily formed into one of the following shapes in the contracting state: a shape in which, as shown in FIG. 2A, the upper lamella portion is downward inclined at the same inclination angle as the lower lamella portion 71*b*; that in which, as shown in FIG. 2B, the upper lamella portion is horizontally formed in parallel with the horizontal line L perpendicular to the axis B; and that in which, as shown in FIG. 2C, the upper lamella portion is upward inclined as moving toward the axis B. In the illustrated examples, edges of the folded portion of each of the ridge-like folds 71 and the valley-like folds 72 are angled. Alternatively, the edges may be rounded (as indicated by the two-dot chain lines R).

Referring to FIG. 1, the pump body 1 comprises a reciprocal driving device 22 which drives the diaphragm 7 to extend and contract. In the reciprocal driving device 22, a cylinder 11 is formed on the side of the upper face of the upper wall 2 of the pump body 1 so that the axis of the cylinder coincides with the axis B of the diaphragm 7, and a piston 12 which reciprocates in the cylinder 11 is coupled to a center portion of a closed upper end portion 7*b* of the diaphragm 7 via a piston rod 13 which is passed through the upper wall 2. Pressurized air which is fed from a pressurized air supplying device (not shown) such as a compressor is supplied alternately to the interior of the cylinder 11 and the air chamber 10 through air holes 14 and 15 which are formed respectively in the cylinder 11 and the upper wall 2. Namely, proximity sensors 16*a* and 16*b* are attached to the cylinder 11, and a sensor sensing member 17 is attached to the piston 12. In accordance with the reciprocal motion of the piston 12, the sensor sensing member 17 alternately approaches the proximity sensors 16*a* and 16*b*, whereby the supply of the pressurized air which is fed from the pressurized air supplying device into the cylinder 11, and that into the air chamber 10 are automatically alternately switched over. In accordance with the reciprocal motion of the piston 12, the bellows 7 is driven to extend and contract.

A suction port 18 and a discharge port 19 are opened in the inner wall 4*a* of the bottom wall member 4 of the pump body 1 which faces the liquid chamber 9 so as to communicate with the inflow passage 5 and the outflow passage 6, respectively. Preferably, the inner wall 4*a* is formed into a shape in which the wall is downward inclined toward the discharge port 19 by 1 to 45°, and more preferably 5 to 15°, and more preferably the discharge port 19 is formed in the lowest position of the inner wall 4*a* which is formed into a conical shape. However, it does not matter whether the discharge port 19 is on the axis B of the diaphragm 7 or in a position deviated from the axis B.

The suction port 18 is disposed in a side face of a protruding tip end portion of a suction check valve 20 which is fixed to the bottom wall member 4 to protrude into the liquid chamber 9 from the inner wall 4*a*, so as to eject sucked liquid to a circumferential wall 9*a* which is in the liquid chamber 9 and in a direction different from the direction of the axis B, i.e., in the illustrated example, the inner peripheral wall of the diaphragm 7 configured by a bellows.

Figure 3:
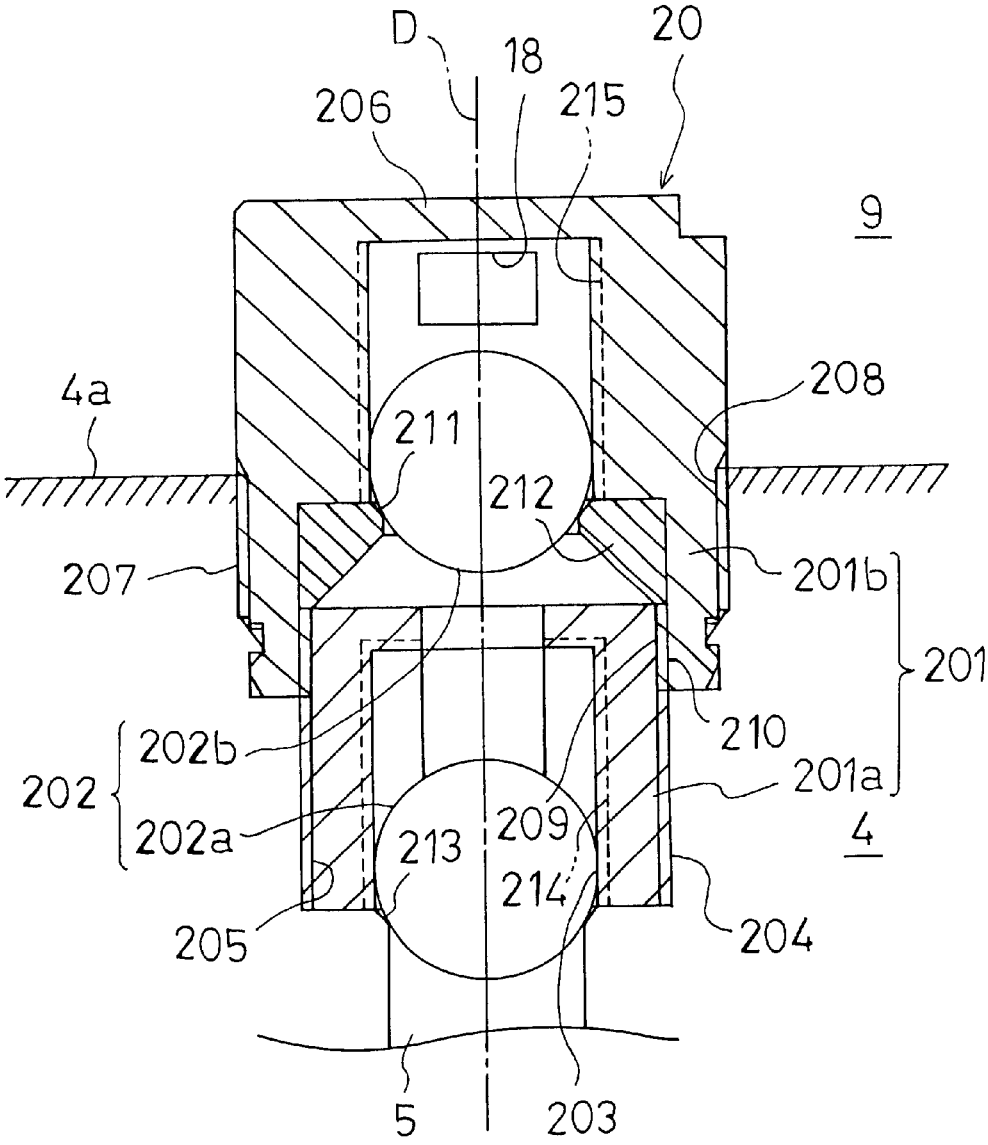
FIG. 3 is an enlarged section view of a suction check valve of the reciprocating pump.

As shown in FIG. 3, the suction check valve 20 is configured by a cylindrical valve casing 201 and ball valve elements 202. The valve casing 201 is fixed to the bottom wall member 4 with setting the axis D of the casing vertical. The illustrated suction check valve 20 has a structure in which the ball valve elements 202 are vertically arranged in two stages.

The valve casing 201 is divided into vertical halves or a first valve casing 201*a* and a second valve casing 201*b*. A first ball valve element 202*a* and a second ball valve element 202*b* are disposed in the first valve casing 201*a* and the second valve casing 201*b*, respectively.

The first valve casing 201*a* is formed into a cylindrical shape, and an inlet 203 is opened in the lower end. An external thread portion 204 which is disposed in the outer periphery of the casing is screwed into an internal thread portion 205 which is disposed in the bottom wall member 4, whereby the first valve casing is fixed to the bottom wall member 4 with setting the axis D vertical.

The second valve casing 201*b* is formed into a cylindrical shape which is larger in diameter than the first valve casing 201*a*, and the suction port 18 is opened in a side face of the upper end. An external thread portion 207 is disposed in the outer periphery of the lower end of the casing. The external thread portion 207 is screwed into an internal thread portion 208 which is disposed in a side of the bottom wall member 4 higher than the internal thread portion 205 so that the diameter is larger than the inner diameter of the internal thread portion 205, and an internal thread portion 209 which is disposed in the inner periphery of the lower end is screwed onto an external thread portion 210 of the upper end of the outer periphery of the first valve casing 201*a*, whereby the second valve casing 201*b* is fixed to the bottom wall member 4 so as to be concentrical with the first valve casing 201*a* and protrude into the liquid chamber 9. In this case, a valve seat element 212 having a valve seat 211 is incorporated between the upper end of the first valve casing 201*a* and the lower end of the inner periphery of the second valve casing 201*b*. A valve seat 213 is disposed in an open end of the inflow passage which faces the inlet 203 in the lower end of the first valve casing 201*a*. The first and second valve casings 201*a* and 201*b*, and the first and second ball valve elements 202*a* and 202*b* are molded by the same material as the diaphragm 7, or a fluororesin which has excellent heat and chemical resistances, such as PTFE or PFA.

According to this configuration, the first ball valve element 202*a* is caused by its own weight to be closely contacted with the valve seat 213 in the first valve casing 201*a*, and the second ball valve element 202*b* is caused by its own weight to be closely contacted with the valve seat 211 in the second valve casing 201*b*, thereby preventing liquid from reversely flowing. When liquid is to be sucked, the first and second ball valve elements 202*a* and 202*b* are respectively upward separated from the valve seats 213 and 211, to open the valve, and the liquid supplied from the inflow passage 5 is ejected from the suction port 18 of the second valve casing 201*b* toward the circumferential wall 9*a* in the liquid chamber 9, with passing between a vertical groove 214 formed in the inner periphery of the first valve casing 201*a* and the first ball valve element 202*a*, and a vertical groove 215 formed in the inner periphery of the second valve casing 201*b* and the ball second valve element 202*b*.

Figure 4:
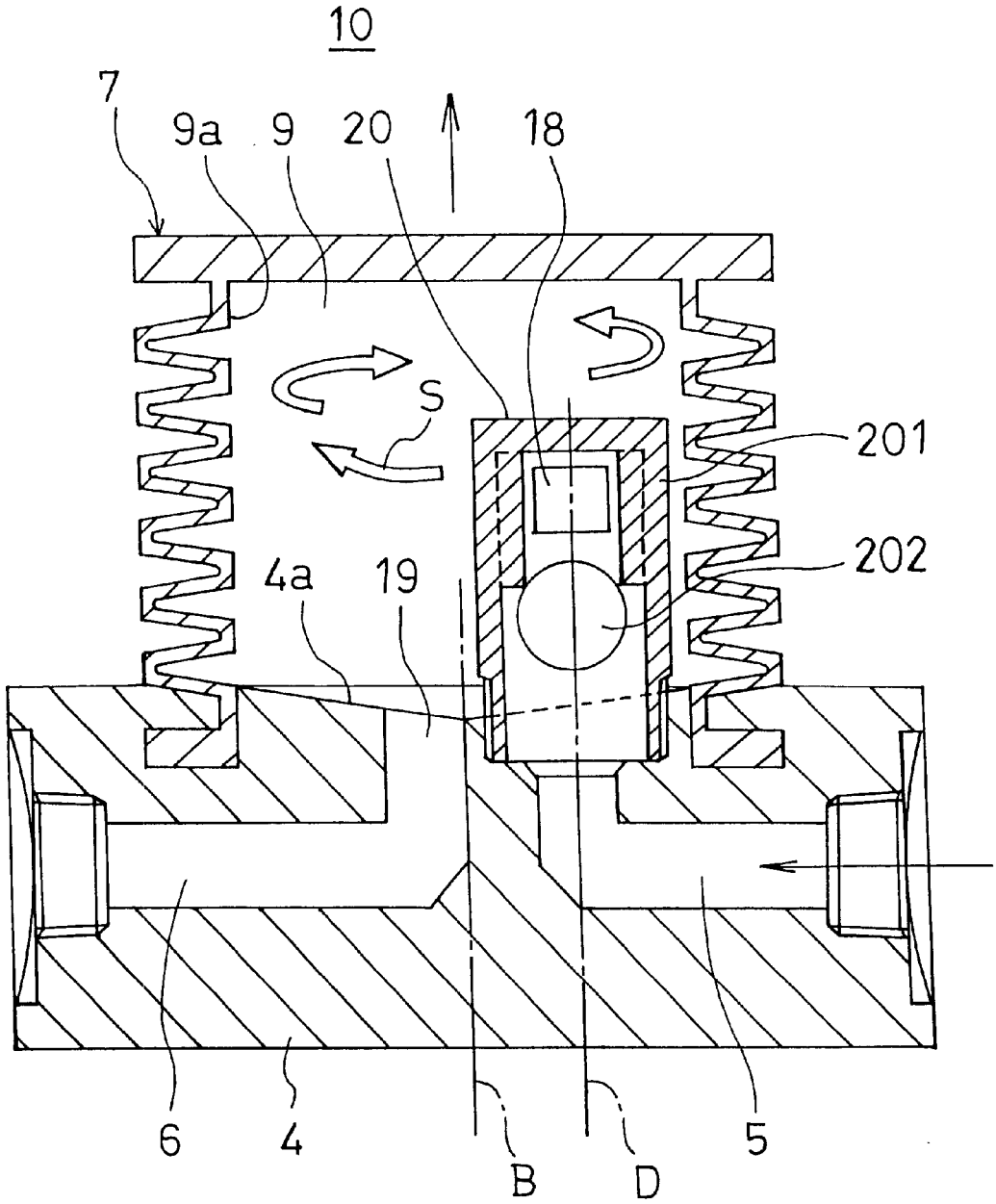
FIG. 4 is a section view showing a flow state of liquid in a suction stroke of the reciprocating pump.
Figure 5:
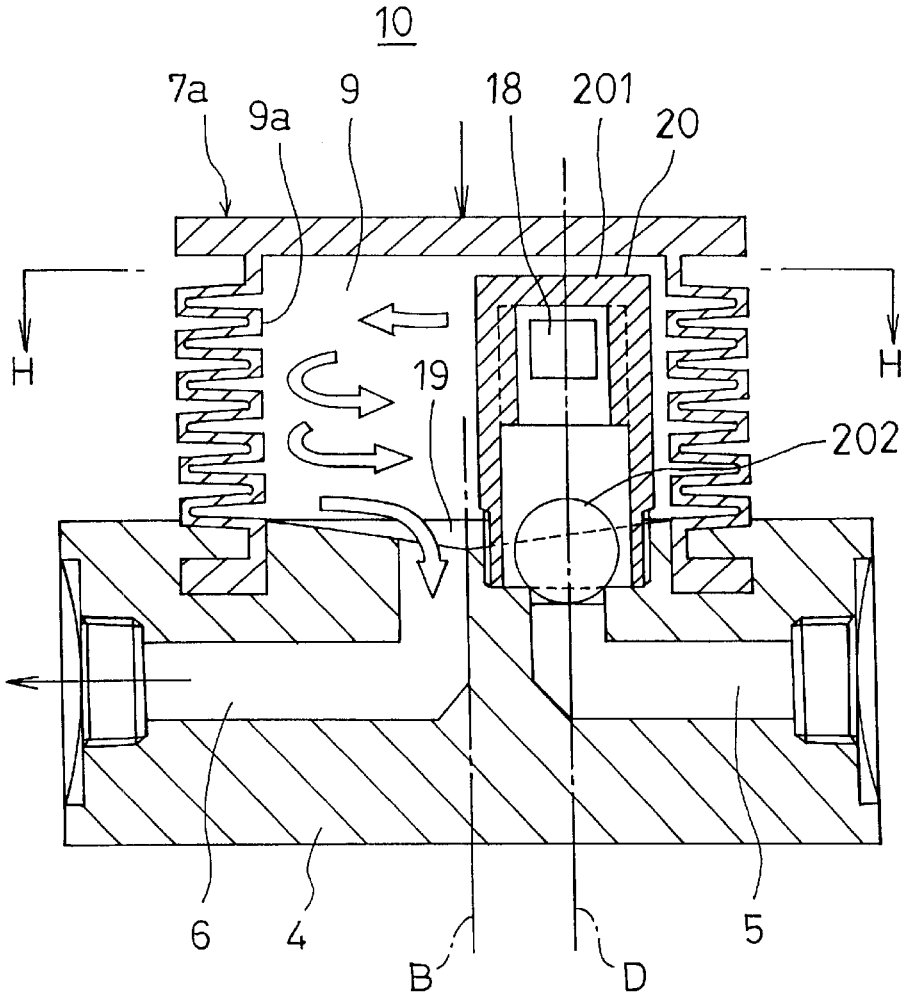
FIG. 5 is a section view showing a flow state of liquid in a discharge stroke of the reciprocating pump.
Figure 6:
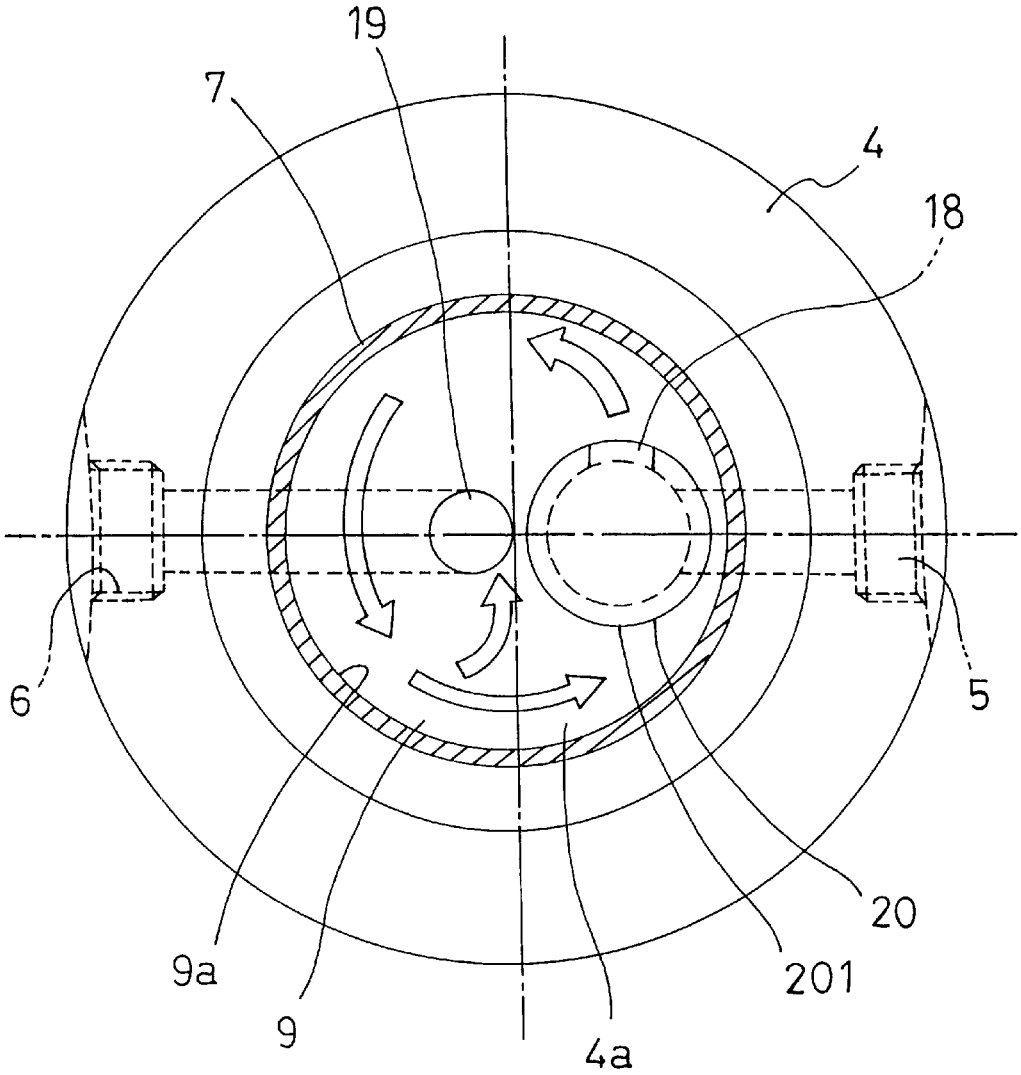
FIG. 6 is a section view taken along the line H—H of FIG. 5.

At this time, since the suction port 18 is disposed so as to eject the sucked liquid toward the circumferential wall 9*a* which is in the liquid chamber 9 and in a direction different from the direction of the axis B, the liquid ejected from the suction port 18 swirls along the circumferential wall 9*a* in the liquid chamber 9, as indicated by the arrows S in FIG. 4 showing the flow direction. This swirling flow can eliminate stagnation and aggregation in the liquid chamber 9, particularly, in the extending and contracting portion of the diaphragm 7, so that the liquid can be always replaced with fresh liquid. FIG. 4 shows a state of a stroke in which the diaphragm 7 is extended to suck the liquid, FIG. 5 shows a state of a stroke in which the diaphragm 7 is contracted to discharge the liquid, and FIG. 6 is a section view taken along the line H—H of FIG. 5. FIGS. 4 and 5 shows the suction check valve 20 in which only one ball valve element 202 is disposed in the single valve casing 201.

By contrast, as shown in FIG. 1, in the accumulator A, the accumulator body 25 has: a cylindrical casing 27 in which an upper end is closed by an upper wall 26; and a bottom wall member 28 which airtightly closes an open lower end of the casing 27.

A diaphragm 29 configured by a bottomed circular cylindrical bellows which is extendingly and contractingly deformable in a direction of the axis C is placed in the casing 27 with setting the axis C vertical. The diaphragm 29 is molded by a fluororesin which has excellent heat and chemical resistances, such as PTFE or PFA. A lower opening peripheral edge 29*a* of the diaphragm is airtightly pressingly fixed to an upper side face of the bottom wall member 28 by an annular fixing plate 30, whereby the inner space of the accumulator body 25 is partitioned into a liquid chamber 31 inside the diaphragm 29, and an air chamber 32 outside the diaphragm 29.

A liquid inflow passage 33 and a liquid outflow passage 34 are formed in the bottom wall member 28 of the accumulator body 25, and an inflow port 23 and an outflow port 24 are disposed in the inner wall 28*a* of the bottom wall member 28 which faces the liquid chamber 31 so as to communicate with the inflow passage 33 and the outflow passage 34, respectively. The inflow passage 33 is communicatingly connected to the downstream end of the outflow passage 6 of the reciprocating pump P via a joint 65.

In the same manner as the inner wall 4*a* of the liquid chamber of the reciprocating pump P, preferably, the inner wall 28*a* of the liquid chamber 31 of the accumulator A is formed into a shape in which the wall is downward inclined by 1 to 45°, and more preferably 5 to 15° as moving toward the outflow port 24, and more preferably the outflow port 24 is formed in the lowest position of the inner wall 28*a* which is formed into a conical shape. However, it does not matter whether the outflow port 24 is on the axis C of the diaphragm 29 or in a position deviated from the axis C.

Figure 7A:
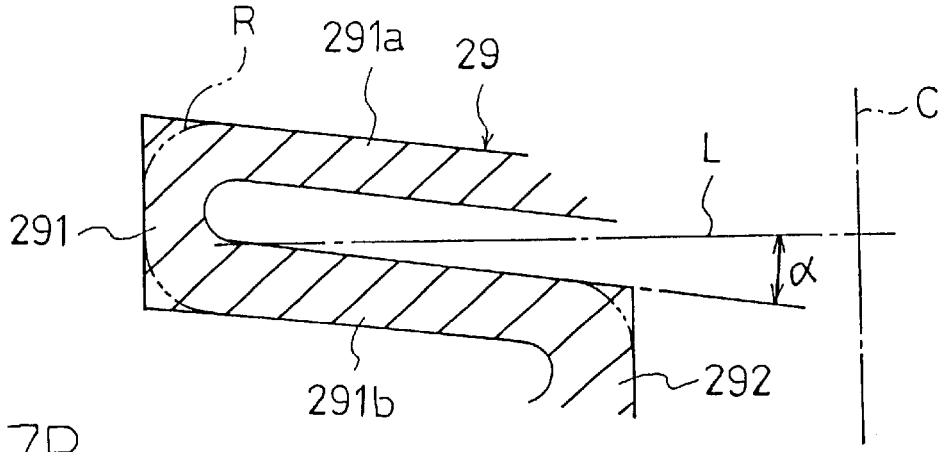
FIG. 7A is an enlarged section view of the extending and contracting portion of the diaphragm of the reciprocating pump.
Figure 7B:
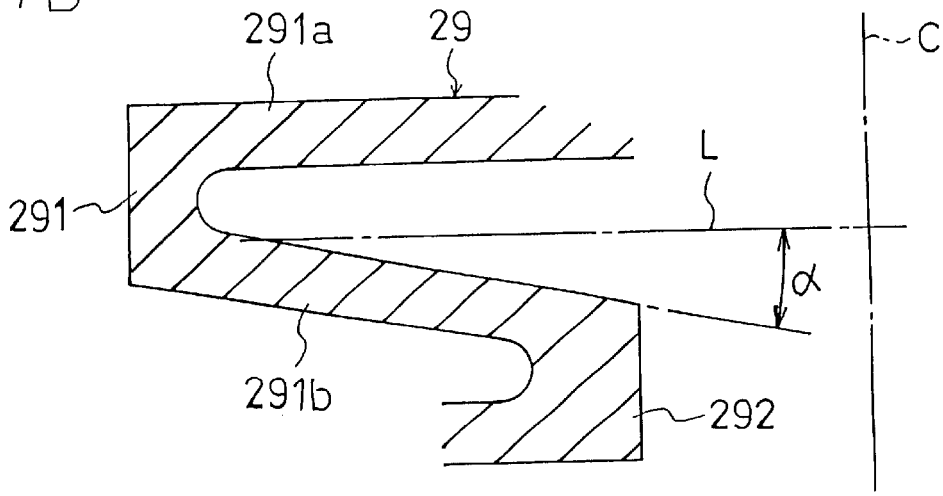
FIG. 7B is an enlarged section view showing another modification of the extending and contracting portion of the diaphragm of the reciprocating pump.
Figure 7C:
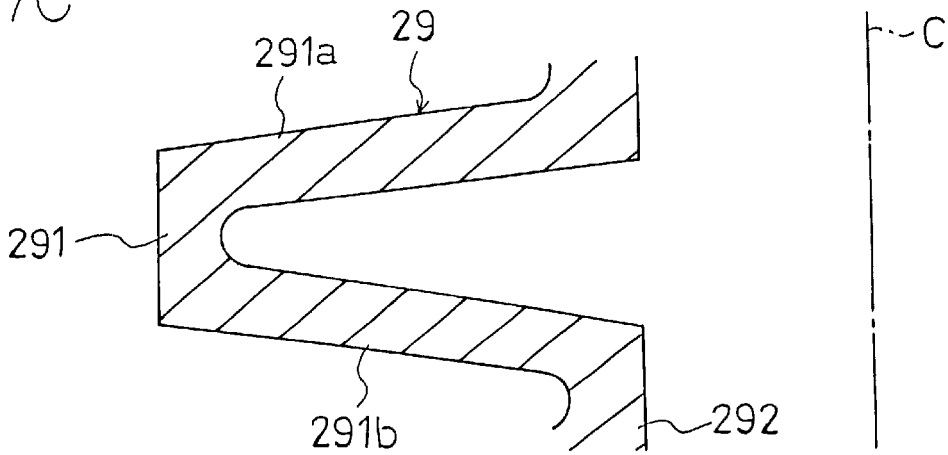
FIG. 7C is an enlarged section view showing a further modification of the extending and contracting portion of the diaphragm of the reciprocating pump.

In the diaphragm 29, in the same manner as the case of the diaphragm 7 of the reciprocating pump P, as shown in FIGS. 7A, 7B, and 7C, the extending and contracting portion of the diaphragm 29 which is configured by forming ridge-like folds 291 and valley-like folds 292 in a vertically alternate and continuous manner is formed into a shape in which the lower one of upper and lower lamella portions 291*a* and 291*b* of each of the ridge-like folds 291, or the lower lamella portion 291*b* is downward inclined as moving toward the axis C, not only in an extending state, but also in a contracting state as shown in FIGS. 7A, 7B, and 7C. In the contracting state of the gridge-like folds 291, the inclination angle a of the lower lamella portion 291*b*, i.e., the angle a formed by a horizontal line L perpendicular to the axis C is 1 to 45°, and more preferably 5 to 15°. However, the upper lamella portion 291*a* of each ridge-like fold 291 may be arbitrarily formed into one of the following shapes in the contracting state: a shape in which, as shown in FIG. 7A, the upper lamella portion is downward inclined at the same inclination angle as the lower lamella portion 291*b*; that in which, as shown in FIG. 7B, the upper lamella portion is horizontally formed in parallel with the horizontal line L perpendicular to the axis C; and that in which, as shown in FIG. 7C, the upper lamella portion is upward inclined as moving toward the axis C. In the illustrated examples, edges of the folded portion of each of the ridge-like folds 291 and the valley-like folds 292 are angled. Alternatively, the edges may be rounded (as indicated by the two-dot chain lines R).

Figure 8:
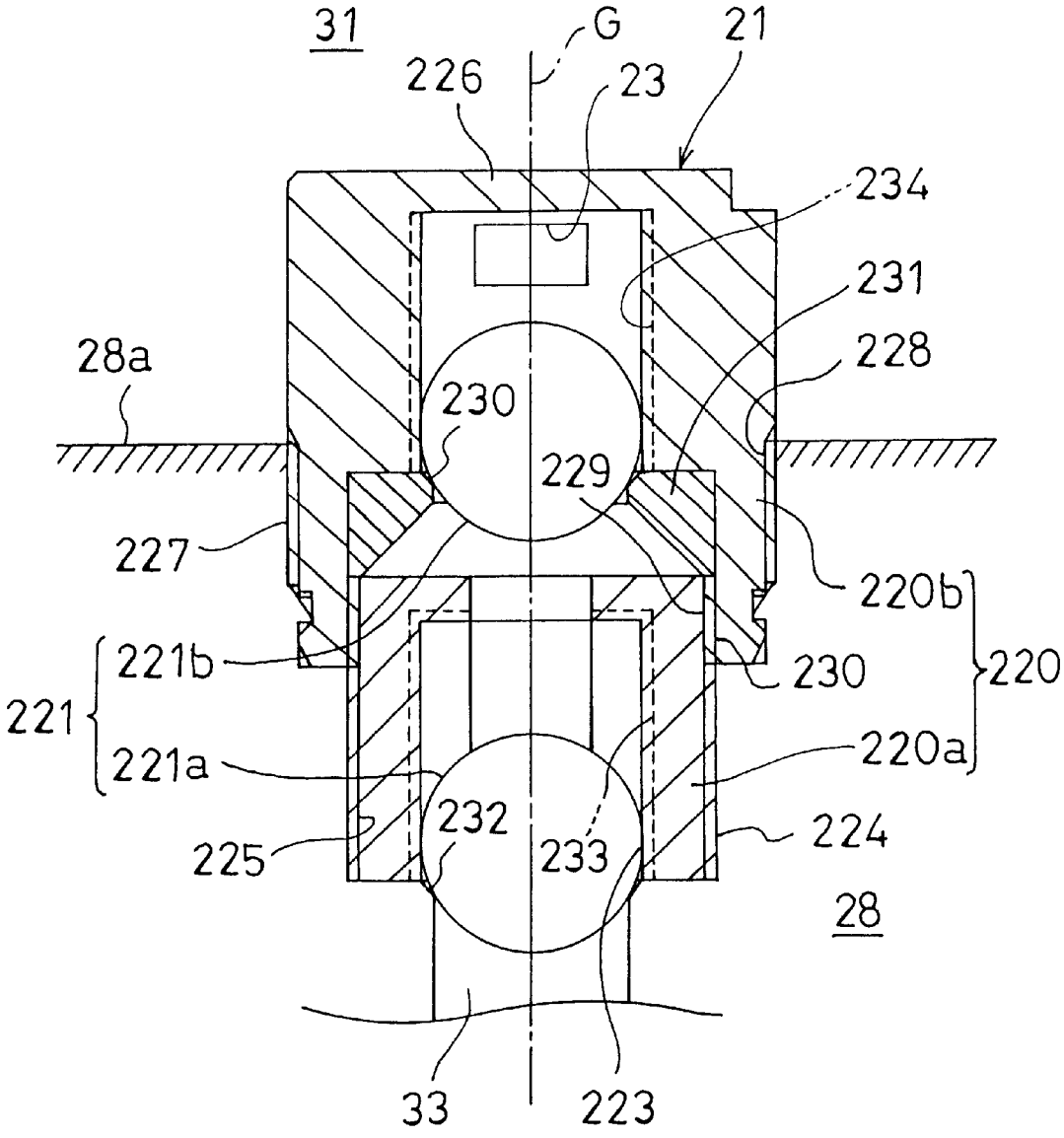
FIG. 8 is an enlarged section view of a discharge check valve of the reciprocating pump disposed in the accumulator.

Referring to FIGS. 1 and 8, the inflow port 23 of the inner wall 28*a* of the liquid chamber 31 is disposed in a side face of a protruding tip end portion of a discharge check valve 21 which is fixed to the bottom wall member 28 to protrude into the liquid chamber 31 from the inner wall 28*a*, so as to eject inflowing liquid to a circumferential wall 31 in the liquid chamber 31 and in a direction different from the direction of the axis C, i.e., in the illustrated example, the inner peripheral wall of the diaphragm 29 configured by a bellows.

The discharge check valve 21 has the same structure as the structure of the above-mentioned suction check valve 20. As shown in FIG. 8, the suction ball type check valve 21 is configured by a cylindrical valve casing 220 and ball valve elements 221. The valve casing 220 is fixed to the bottom wall member 28 with setting the axis G of the casing vertical. The valve casing 220 is divided into vertical halves or a first valve casing 220*a* and a second valve casing 220*b*. A first ball valve element 221*a* and a second ball valve element 221*b* are disposed in the first valve casing 220*a* and the second valve casing 220*b*, respectively.

The first valve casing 220*a* is formed into a cylindrical shape, and an inlet 223 is opened in the lower end. An external thread portion 224 which is disposed in the outer periphery of the casing is screwed into an internal thread portion 225 which is disposed in the bottom wall member 28, whereby the first valve casing is fixed to the bottom wall member 28 with setting the axis G vertical.

The second valve casing 220*b* is formed into a cylindrical shape which is larger in diameter than the first valve casing 220*a*, and the inflow port 23 is opened in a side face of the upper end. An external thread portion 227 is disposed in the outer periphery of the lower end of the casing. The external thread portion 227 is screwed into an internal thread portion 228 which is disposed in an upper step side of the bottom wall member 28 higher than the internal thread portion 225 so that the diameter is larger than the inner diameter of the internal thread portion 225, and an internal thread portion 229 which is disposed in the inner periphery of the lower end is screwed onto an external thread portion 230 of the upper end of the outer periphery of the first valve casing 220*a*, whereby the second valve casing is fixed to the bottom wall member 28 so as to be concentrical with the first valve casing 220*a* and protrude into the liquid chamber 31. In this case, a valve seat element 231 having a valve seat 230 is incorporated between the upper end of the first valve casing 220*a* and the lower end of the inner periphery of the second valve casing 220*b*. A valve seat 232 is disposed in an open end of the inflow passage 33 which faces the inlet 223 in the lower end of the first valve casing 220*a*.

According to this configuration, the first ball valve element 221*a* is caused by its own weight to be closely contacted with the valve seat 232 in the first valve casing 221*a*, and the second ball valve element 221*b* is caused by its own weight to be closely contacted with the valve seat 230 in the second valve casing 220*b*, thereby preventing liquid from reversely flowing. When liquid is to be discharged to the liquid chamber 31, the first and second ball valve elements 221*a* and 221*b* are respectively upward separated from the valve seats 232 and 230, to open the valve, and the liquid supplied from the reciprocating pump P is ejected toward the circumferential wall 31*a* in the liquid chamber 31 from the inflow port 23 of the second valve casing 220*b* with passing between a vertical groove 233 formed in the inner periphery of the first valve casing 220*a* and the first ball valve element 221*a*, and a vertical groove 234 formed in the inner periphery of the second valve casing 220*b* and the second ball valve element 221*b*.

At this time, since the inflow port 23 is disposed so as to eject the inflowing liquid toward the circumferential wall 31*a* which is in the liquid chamber 31 and in a direction different from the direction of the axis C, the liquid ejected from the inflow port 23 swirls along the circumferential wall 31*a* in the liquid chamber 31. This swirling flow can eliminate stagnation and aggregation in the liquid chamber 31, particularly, in the extending and contracting portion of the diaphragm 29, so that the liquid can be always replaced with fresh liquid.

The first and second valve casings 220*a* and 220*b*, and the first and second ball valve elements 221*a* and 221*b* are molded by a fluororesin which has excellent heat and chemical resistances, such as PTFE or PFA, in the same manner as the casings and valve elements of the suction check valve 20.

Figure 9:
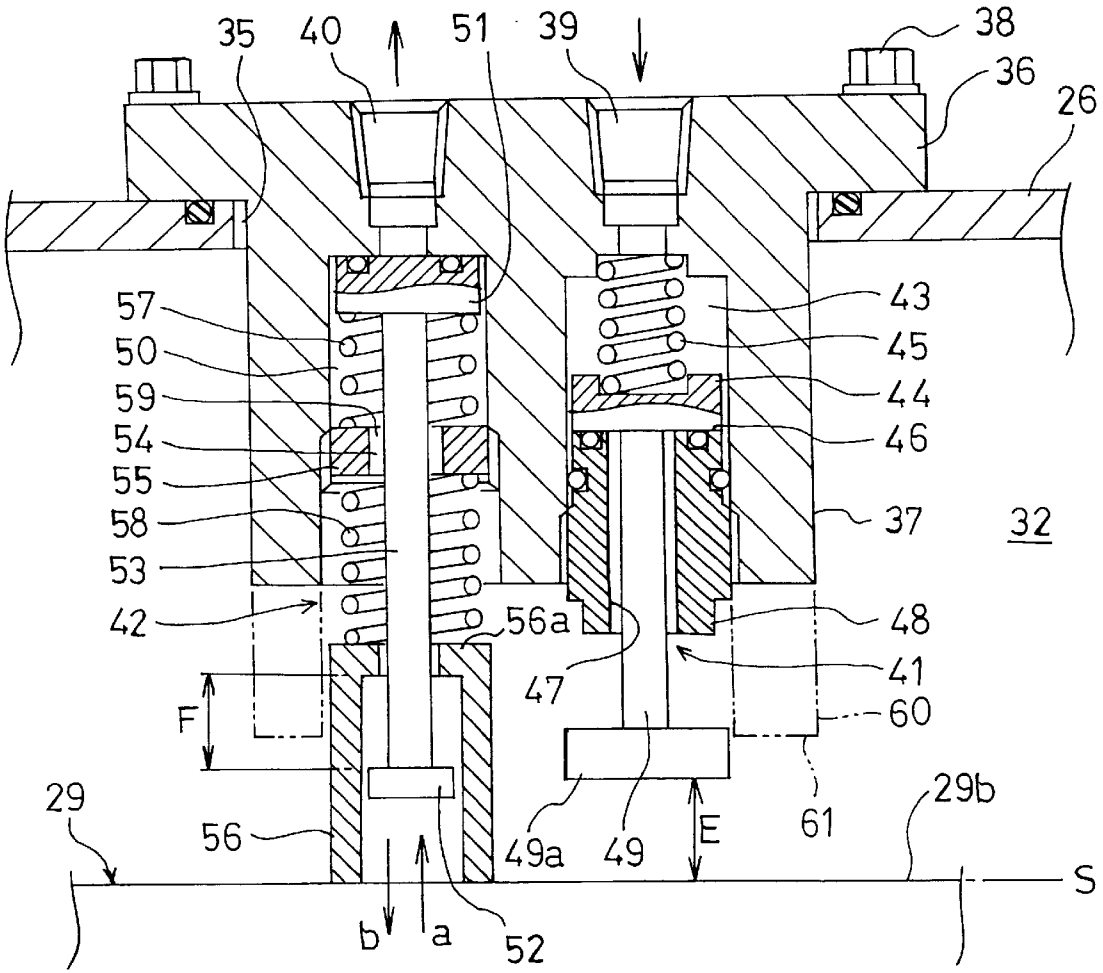
FIG. 9 is an enlarged longitudinal sectional front view of an automatic pressure adjusting mechanism of the accumulator.

As shown in FIG. 9, an opening 35 for allowing air to inflow and outflow is formed in the vicinity of the center of the outer face of the upper wall 26 of the casing 27 of the accumulator A, a valve case 37 having a flange 36 is fitted into the opening 35, and the flange 36 is detachably fastened and fixed to the outside of the upper wall 26 by bolts 38 and the like.

An air supply port 39 and an air discharge port 40 are formed in the valve case 37 so as to be juxtaposed in parallel. An automatic air supply valve mechanism 41 is disposed in the air supply port 39. When the capacity of the liquid chamber 31 is increased to exceed a predetermined range, the air supply valve mechanism supplies air of a pressure which is equal to or higher than the maximum pressure of the transported liquid, into the air chamber 32, thereby raising the filling pressure in the air chamber 32. An automatic air discharge valve mechanism 42 is disposed in the air discharge port 40. When the capacity of the liquid chamber 31 is decreased to exceed the predetermined range, the air discharge valve mechanism discharges air from the air chamber 32 to lower the filling pressure in the air chamber 32.

The automatic air supply valve mechanism 41 comprises: an air supply valve chamber 43 which is formed in the valve case 37 so as to communicate with the air supply port 39; an air supply valve element 44 which is slidable in the valve chamber 43 along the axial direction of the chamber to open and close the air supply port 39; a spring 45 which always urges the valve element 44 to the closing position; a guide member 48 having, in an inner end portion, a valve seat 46 for the air supply valve element 44, and a through hole 47 through which the air supply valve chamber 43 and the air chamber 32 communicate with each other, the guide member 48 being screwingly fixed to the valve case 37; and a valve operating rod 49 which is slidably passed through the through hole 47 of the guide member 48. Under the condition where the diaphragm 29 is in the reference position S in a mean pressure state of the liquid pressure in the liquid chamber 31, the air supply valve element 44 is in close contact with the valve seat 46 of the guide member 48 to close the air supply port 39, and an end portion 49*a* of the valve operating rod 49 which faces the air chamber 32 is separated from a closed upper end portion 29*b* of the diaphragm 29 by a stroke E.

By contrast, the automatic air discharge valve mechanism 42 comprises: an air discharge valve chamber 50 which is formed in the valve case 37 so as to communicate with the air discharge port 40; an air discharge valve element 51 which is slidable in the valve chamber 50 along the axial direction of the chamber to open and close the air discharge port 40; an air discharge valve rod 53 in which the valve element 51 is disposed at the tip end, and a flange 52 is disposed at the rear end; a spring receiver 55 screwingly fixed into the air discharge valve chamber 50, and having a through hole 54 through which the air discharge valve rod 53 is passed; a cylindrical slider 56 through which a rear end portion of the air discharge valve rod 53 is slidably passed, and which is prevented by the flange 52 from slipping off; a closing spring 57 which is disposed between the air discharge valve element 51 and the spring receiver 55; and an opening spring 58 which is disposed between the spring receiver 55 and the slider 56. The inner diameter of the through hole 54 of the spring receiver 55 is larger than the shaft diameter of the air discharge valve rod 53, so as to form a gap 59 between the two components. The air discharge valve chamber 50 and the air chamber 32 communicate with each other via the gap 59. Under the state where the diaphragm 29 is in the reference position S, the air discharge valve element 51 closes the air discharge port 40, and the flange 52 at the rear end of the air discharge valve rod 53 is separated from the inner face of a closing end portion 56*a* of the slider 56 by a stroke F.

As indicated by the phantom line 60 in FIG. 9, an end of the valve case 37 on the side of the air chamber is elongated in the direction of the interior of the air chamber 32, and a stopper 61 is disposed at the end of the elongated portion. When the diaphragm 29 is moved in the direction of extending the liquid chamber 31 in excess of the predetermined stroke E to operate the valve operating rod 49, the stopper restricts a further movement of the diaphragm 29.

Next, the operations of the reciprocating pump P and the accumulator A which are configured as described above will be described.

When the pressurized air which is fed from the pressurized air supplying device (not shown) such as a compressor is supplied to the interior of the cylinder 11 via the air hole 14, the piston 12 is raised in the direction x in FIG. 1, and the diaphragm 7 extends in the same direction to eject the transported liquid in the inflow passage 5 from the suction port 18 via the suction check valve 20 toward the circumferential wall 9*a* in the liquid chamber 9. At this time, the sucked liquid ejected from the suction port 18 produces a swirling flow along the circumferential wall 9*a* in the liquid chamber 9, and the interior of the liquid chamber is stirred by the swirling flow. Therefore, staying of liquid in the liquid chamber 9 is eliminated to enable fresh liquid to be always supplied, and, even in the case where liquid containing a sedimenting material such as slurry is used, the sedimenting material can be effectively prevented from sedimenting and aggregating in the liquid chamber 9. When the pressurized air is supplied into the air chamber 10 via the air hole 15 and air is discharged through the air hole 14, the piston 12 is lowered in the direction y in FIG. 1, and the diaphragm 7 contracts in the same direction to discharge the transported liquid in the liquid chamber 9 from the discharge port 19. When the diaphragm 7 is driven to perform extending and contracting reciprocal motion by the reciprocal motion of the piston 12 in the cylinder 11 as described above, the suction stroke from the suction port 18, and the discharge stroke to the discharge port 19 are alternately repeated to conduct a predetermined reciprocating pumping action. When the transported liquid is fed to a predetermined portion by this operation of the reciprocating pump P, the reciprocating pump discharge pressure generates pulsations due to repetition of peak and valley portions.

The transported liquid discharged from the liquid chamber 9 of the reciprocating pump P via the discharge port 19 is passed through the inflow passage 33 and the inflow port 23 of the accumulator A and then ejected from the inflow port 23 of the discharge check valve 21 toward the circumferential wall 31*a* in the liquid chamber 31. The liquid is temporarily stored in the liquid chamber 31, and thereafter flows out from the outflow port 24 into the outflow passage 34. When the discharge pressure of the transported liquid is in a peak portion of a discharge pressure curve, the transported liquid causes the diaphragm 29 to be extendingly deformed so as to increase the capacity of the liquid chamber 31, and hence the pressure of the liquid is absorbed. At this time, the flow quantity of the transported liquid flowing out from the liquid chamber 31 is smaller than that of the liquid supplied from the reciprocating pump P.

As described above, the transported liquid from the inflow port 23 is ejected toward the circumferential wall 31*a* in the liquid chamber 31. Therefore, the inflowing liquid produces a swirling flow along the circumferential wall 31*a* in the liquid chamber 31, and the interior of the liquid chamber 31 is stirred by the swirling flow. Therefore, staying of liquid in the liquid chamber 31 is reduced to enable fresh liquid to be always supplied, and, even in the case where liquid containing a sedimenting material such as slurry is used, the sedimenting material can be effectively prevented from sedimenting and aggregating in the liquid chamber 31.

When the discharge pressure of the transported liquid comes to a valley portion of the discharge pressure curve, the pressure of the transported liquid becomes lower than the filling pressure of the air chamber 32 which is compressed by extending deformation of the diaphragm 29 of the accumulator A, and hence the diaphragm 29 is contractingly deformed. At this time, the flow quantity of the transported liquid flowing out from the liquid chamber 31 is larger than that of the liquid flowing into the liquid chamber 31 from the reciprocating pump P. This repeated operation, i.e., the capacity change of the liquid chamber 31 causes the pulsations to be absorbed and suppressed.

When the discharge pressure of the reciprocating pump P is varied in the increasing direction during such an operation, the capacity of the liquid chamber 31 is increased by the transported liquid, with the result that the diaphragm 29 is largely extendingly deformed. When the amount of extending deformation of the diaphragm 29 exceeds the predetermined range E, the closed upper end portion 29*b* of the diaphragm 29 pushes the valve operating rod 49 toward the valve chamber. This causes the air supply valve element 44 of the automatic air supply valve mechanism 41 to be opened against the force of the spring 45, and air of the high pressure is supplied into the air chamber 32 through the air supply port 39, with the result that the filling pressure of the air chamber 32 is raised. Therefore, the amount of extending deformation of the diaphragm 29 is restricted so as not to exceed the stroke E, whereby the capacity of the liquid chamber 31 is suppressed from being excessively increased. When the stopper 61 is disposed at the end of the valve case 37 on the side of the air chamber, the closed upper end portion 29*b* of the diaphragm 29 abuts against the stopper 61, so that the diaphragm 29 can be surely prevented from being excessively extendingly deformed. This is advantageous to prevent the bellows from being damaged. In accordance with the rise of the filling pressure in the air chamber 32, the diaphragm 29 contracts toward the reference position S. Therefore, the valve operating rod 49 separates from the closed upper end portion 29*b* of the diaphragm 29, and the air supply valve element 44 returns to the closing position, so that the filling pressure in the air chamber 32 is fixed to an adjusted state.

By contrast, when the discharge pressure of the reciprocating pump P is varied in the decreasing direction, the capacity of the liquid chamber 31 is decreased by the transported liquid, with the result that the diaphragm 29 is largely contractingly deformed. When the amount of contracting deformation of the diaphragm 29 exceeds the predetermined range F, the slider 56 of the automatic air discharge valve mechanism 42 is moved in the contraction direction b of the diaphragm 29 by the urging function of the opening spring 58, in accordance with the movement of the closed upper end portion 29*b* of the diaphragm 29 in the contraction direction b, and the inner face of the closing end portion 56*a* of the slider 56 is engaged with the flange 52 of the air discharge valve rod 53. This causes the air discharge valve rod 53 to be moved in the direction b and the air discharge valve element 51 opens the air discharge port 40. As a result, the filled air in the air chamber 32 is discharged into the atmosphere through the air discharge port 40, and the filling pressure of the air chamber 32 is lowered. Therefore, the amount of contracting deformation of the diaphragm 29 is restricted so as not to exceed the stroke F, whereby the capacity of the liquid chamber 31 is suppressed from being excessively decreased. In accordance with the reduction of the filling pressure in the air chamber 32, the diaphragm 29 extends toward the reference position S. Therefore, the slider 56 is pushed by the closed upper end portion 29*b* of the diaphragm 29, to compress the opening spring 58 while moving in the direction a. The air discharge valve element 51 again closes the air discharge port 40 by the urging function of the closing spring 57, whereby the filling pressure in the air chamber 32 is fixed to the adjusted state. As a result, pulsations are efficiently absorbed and the amplitude of pulsations is suppressed to a low level, irrespective of variation of the discharge pressure from the liquid chamber 9 of the reciprocating pump P.

In the accumulator A of the embodiment, an automatic pressure adjusting mechanism configured by an automatic air supply valve mechanism 41 and an automatic air discharge valve mechanism 42 is provided in the air chamber 32. A mechanism of the configuration shown in FIGS. 10 to 17 may be employed as the automatic pressure adjusting mechanism.

Figure 10:
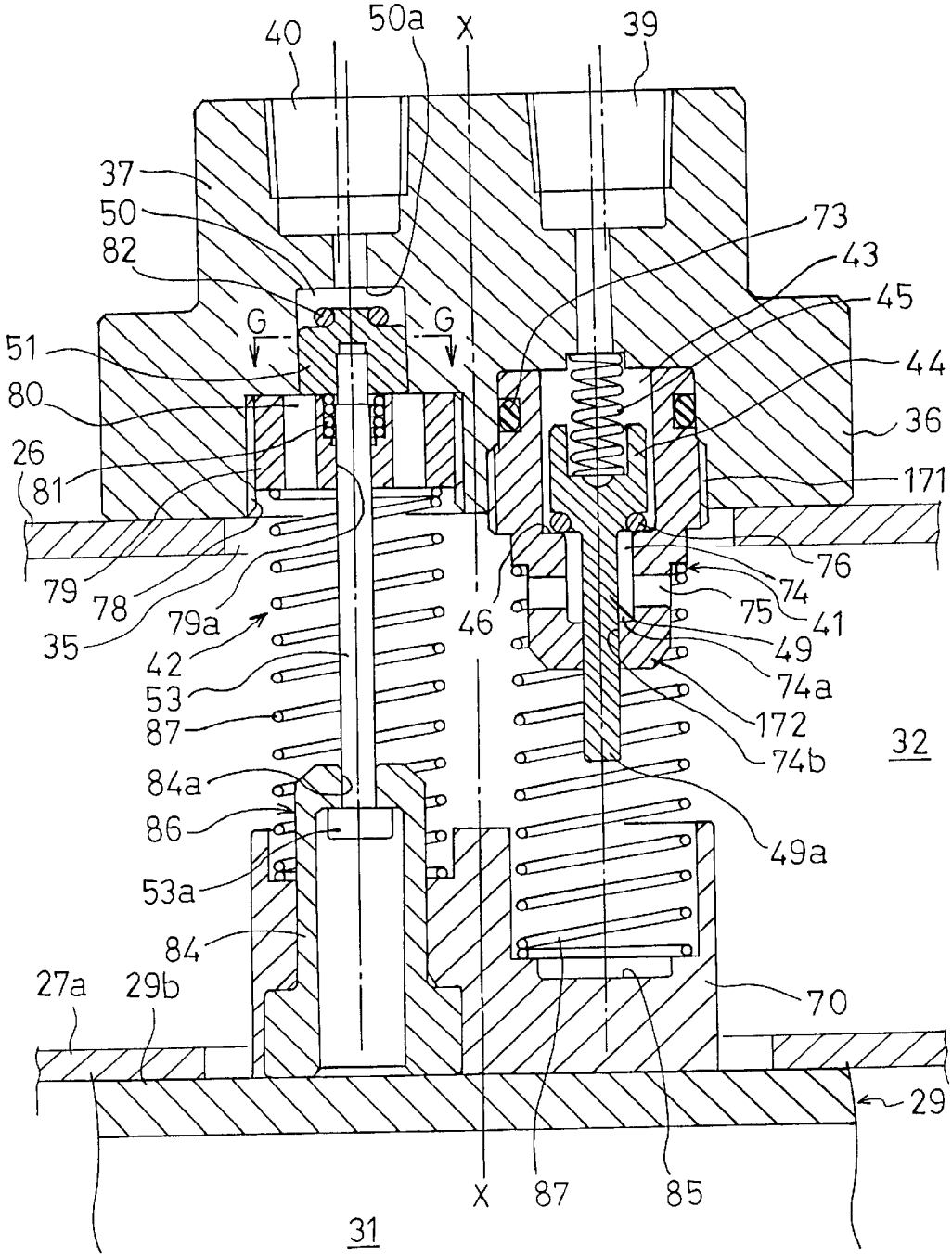
FIG. 10 is an enlarged longitudinal sectional front view showing another modification of the automatic pressure adjusting mechanism of the accumulator.

Specifically, as shown in FIG. 10, in the automatic pressure adjusting mechanism, an opening 35 is formed in the vicinity of the center of the upper wall 26 of the casing 27 of the accumulator A, a valve case 37 into which air supply and discharge valves are incorporated is fitted into the opening 35, and the flange 36 attached to the outer periphery of the rear end of the valve case 37 is detachably fastened and fixed to the upper wall 26 by bolts and the like. On the other hand, an air supply/discharge valve control plate 70 is abuttingly placed in a center area of the closed upper end portion 29*b* of the diaphragm 29 facing the air chamber 32, so as to be opposed to the valve case 37.

Figure 11:
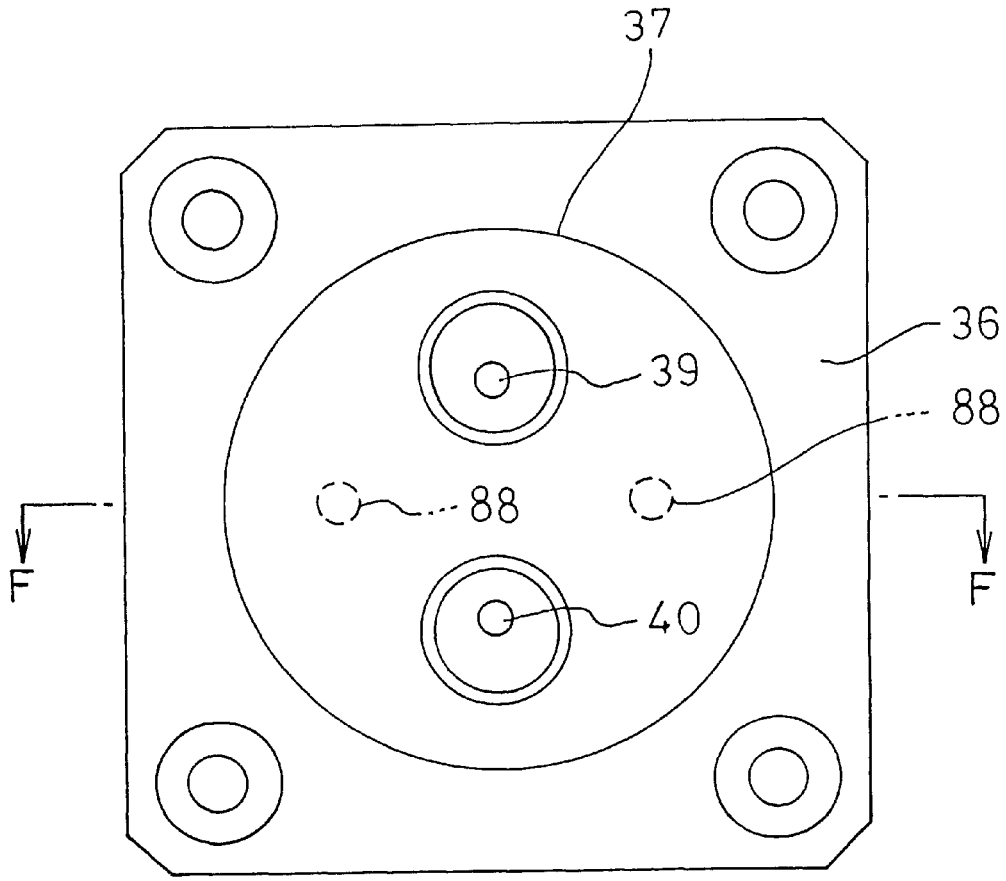
FIG. 11 is a plan view of the automatic pressure adjusting mechanism shown in FIG. 10.

As shown in FIG. 11, an air supply port 39 and an air discharge port 40 are juxtaposed in the front end face of the valve case 37. The automatic air supply valve mechanism 41 is disposed in the air supply port 39. When the capacity of the liquid chamber 31 is increased to exceed a predetermined range, the automatic air supply valve mechanism supplies air of a pressure which is higher than the maximum pressure of the transported liquid, into the air chamber 32, thereby raising the filling pressure in the air chamber 32. The automatic air discharge valve mechanism 42 is disposed in the air discharge port 40. When the capacity of the liquid chamber 31 is reduced to exceed the predetermined range, the automatic air discharge valve mechanism discharges air from the air chamber 32, thereby lowering the filling pressure in the air chamber 32.

In the automatic air supply valve mechanism 41, as shown in FIG. 10, an internal thread portion 171 is formed in the rear end face of the valve case 37 so as to communicate with the air supply port 39, and an air supply valve holder 172 which holds an air supply valve element 44 and a valve rod 49 that is integral with the valve element is screwingly fixed to the internal thread portion 171 via an O-ring 73. In the air supply valve holder 172, an air supply valve chamber 43 is formed in a front side end portion which is screwed into the internal thread portion 171, a valve seat 46 is formed in the inner bottom of the air supply valve chamber 43, and a valve rod passing hole 74 is formed in the rear end portion so as to coaxially communicate with the air supply valve chamber 43. A plurality of communication holes 75 through which the air supply valve chamber 43 communicates with the air chamber 32 via the valve rod passing hole 74 are formed in the outer periphery of the rear end portion of the air supply valve holder 172. The formation of the communication holes 75 improves the responsibility to a pressure change in the air chamber 32.

In the air supply valve holder 172, an air supply valve 36 is incorporated into the air supply valve chamber 43 so as to be movable in the axial direction, and the valve rod 49 is passed through the valve rod passing hole 74. A rear end portion of the valve rod 49 protrudes into the rear of the air supply valve holder 172. The valve rod passing hole 74 is formed into a stepped shape having: a larger diameter hole portion 74*a* in which the inner diameter is larger than the outer diameter of the valve rod 49 to form a communication gap between the hole portion and the valve rod 49; and a guide hole portion 74*b* which is slightly larger than the outer diameter of the valve rod 49 and slidingly contacted with the valve rod 49 without leaving a substantial gap therebetween.

When the valve rod 49 of the air valve element 44 is slidingly guided by the guide hole portion 74*b*, the air valve element 44 can be straightly moved in the air supply valve chamber 43 along the axial direction of the chamber.

Figure 13:
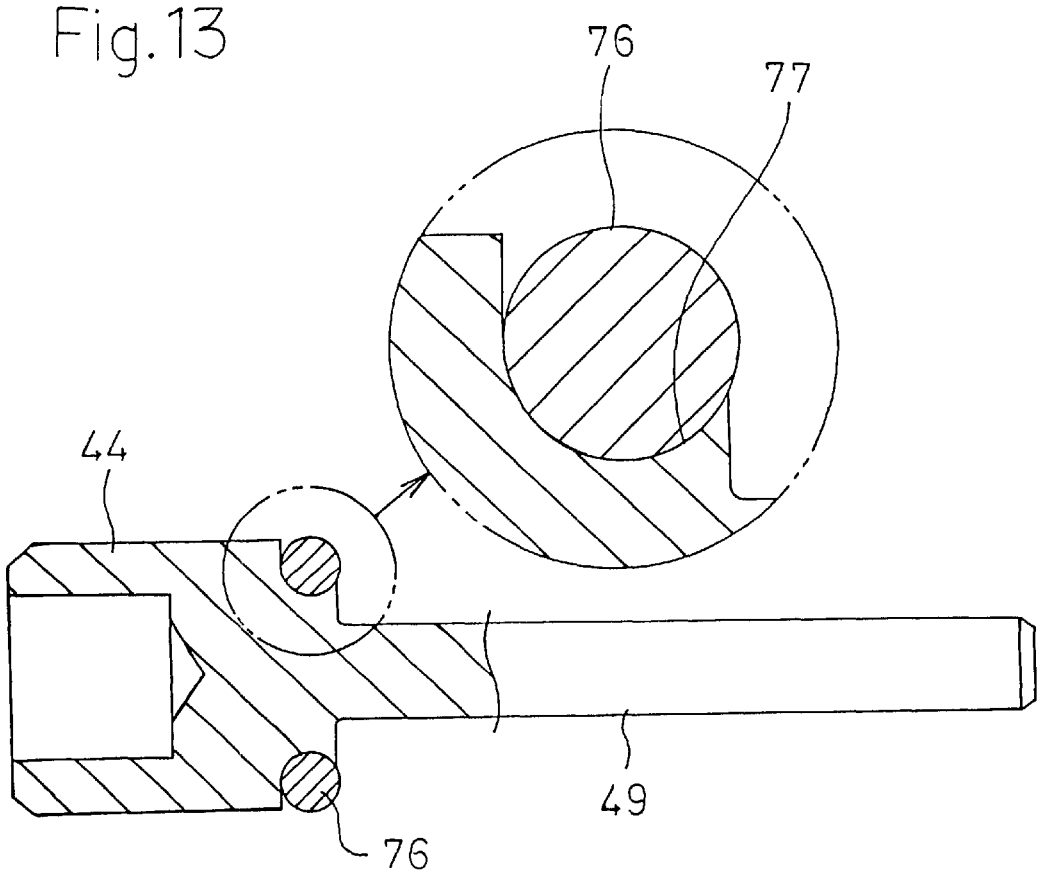
FIG. 13 is a section view of an air supply valve of the automatic pressure adjusting mechanism shown in FIG. 10.

In the air supply valve chamber 43, the air supply valve element 44 is always urged by a spring 45 so as to be in the closing position where the element is closely contacted with the valve seat 46. The air supply valve element 44 is airtightly contacted with the valve seat 46 via an O-ring 76. As shown in FIG. 13, the O-ring 76 is fitted into an arcuate groove 77 formed in a corner portion of the rear end face of the air supply valve element 44, whereby the O-ring is lockedly attached to the valve element.

In a state where the liquid pressure in the liquid chamber 31 is at an average pressure and the diaphragm 29 is in the reference position, the air supply valve element 44 is closely contacted with the valve seat 46 of the valve rod holder 172 to close the air supply port 39, and an end portion 49*a* of the valve rod 49 facing the interior of the air chamber 32 is separated from the closed upper end portion 29*b* of the diaphragm 29 by a predetermined stroke.

Figure 14:
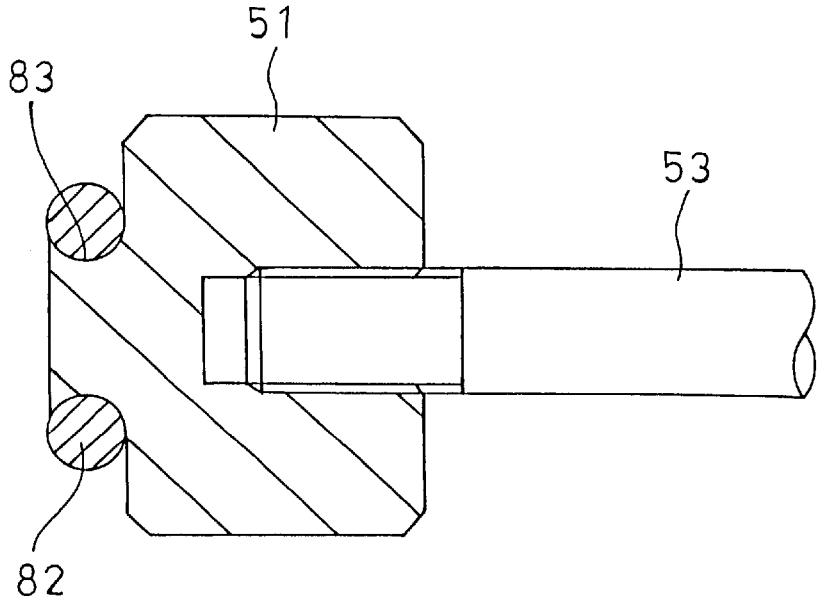
FIG. 14 is a section view of an air discharge valve of the automatic pressure adjusting mechanism shown in FIG. 10.
Figure 15:
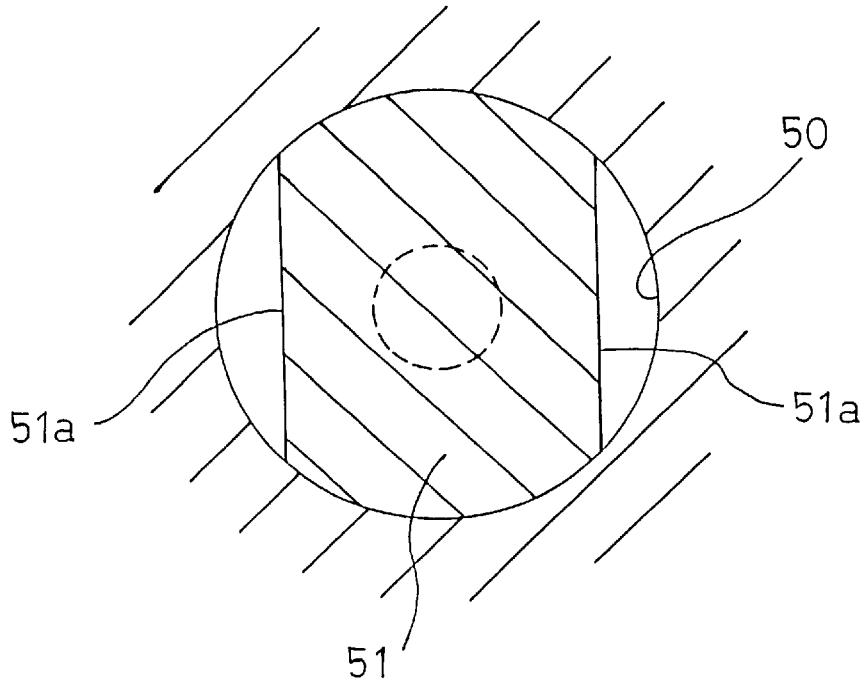
FIG. 15 is a section view taken along the line G—G of FIG. 10.

On the other hand, in the automatic air discharge valve mechanism 42, as shown in FIG. 10, an air discharge valve chamber 50 having a circular section shape, and an internal thread portion 78 having an inner diameter which is larger than that of the air discharge valve chamber 50 are formed in the rear end face of the valve case 37 so as to coaxially communicate with the air discharge port 40. The air discharge valve element 51 having a shape in which flat faces 51*a* are formed in opposing portions on the circumference as shown in FIG. 14 is incorporated in the air discharge valve chamber 50 so as to be movable along the axial direction. The air discharge valve rod 53 is integrally coupled to the air discharge valve element 51. The air discharge valve rod 53 is passed through and held by a valve rod guide hole portion 79*a* so as to be slidable in the axial direction. The valve rod guide hole portion 79*a* is in the center of a discharge valve rod holder 79 which is screwingly fixed to the internal thread portion 78. In the air discharge valve rod holder 79, a plurality of communication holes 80 through which the air discharge valve chamber 50 communicates with the air chamber 32 are formed on the same circle that is centered at the valve rod guide hole portion 79*a*. A spring 81 through which the air discharge valve rod 53 is passed is interposed between the air discharge valve element 51 and the air discharge valve rod holder 79. The air discharge valve element 51 is always urged by the spring 81 so as to be in the closing position where the element is closely contacted with the valve seat 50*a* of the air discharge valve chamber 50. The air discharge valve element 51 is airtightly contacted with the valve seat 50*a* via an O-ring 82. As shown in FIG. 14, the O-ring 82 is fitted into an arcuate groove 83 formed in a corner portion of the front end face of the air discharge valve element 51, whereby the O-ring is lockedly attached to the valve element.

In a state where the diaphragm 29 is in the reference position, the air discharge valve element 51 closes the air discharge port 40, and a flange 53*a* in the rear end of the air discharge valve rod 53 is separated from the inner face of a closed end portion 84*a* of a sleeve 84 by a predetermined stroke.

On the other hand, the air supply/discharge valve control plate 70 which is abuttingly placed in the center area of the closed upper end portion 29*b* of the diaphragm 29 is formed into a disk-like shape, an air supply valve rod pressing portion 85 is recessed in the front face of the plate, and the sleeve 84 constituting an air discharge valve rod pulling portion 86 is fittingly fixed in juxtaposition with the air supply valve rod pressing portion 85. A guide hole portion 84*a* which is slightly larger than the outer diameter of the air discharge valve rod 53 and slidingly contacted with the valve rod 53 without leaving a substantial gap therebetween is formed in a front end portion of the sleeve 84. The rear end portion of the air discharge valve rod 53 having the flange 53*a* is passed through and coupled to the guide hole portion 84*a* in a slidable and slipping-off preventing manner. When the air discharge valve rod 53 is slidingly guided by the guide hole portion 84*a*, the air discharge valve rod 53 can be straightly moved along the axial direction. The sleeve 84 may be formed integrally with the air supply/discharge valve control plate 70.

Springs 87 each consisting of a compression coil spring are interposed between the air supply valve rod pressing portion 85 of the air supply/discharge valve control plate 70 and the rear end portion of the air supply valve holder 172, and the sleeve 84 and the rear end face of the air discharge valve rod holder 79, so as to surround the outer peripheries of the air supply valve rod 49 and the air discharge valve rod 53, respectively. The air supply/discharge valve control plate 70 is urged by the springs 87 and 87 to be pressed toward the center area of the closed upper end portion 29*b* of the diaphragm 29.

Figure 12:
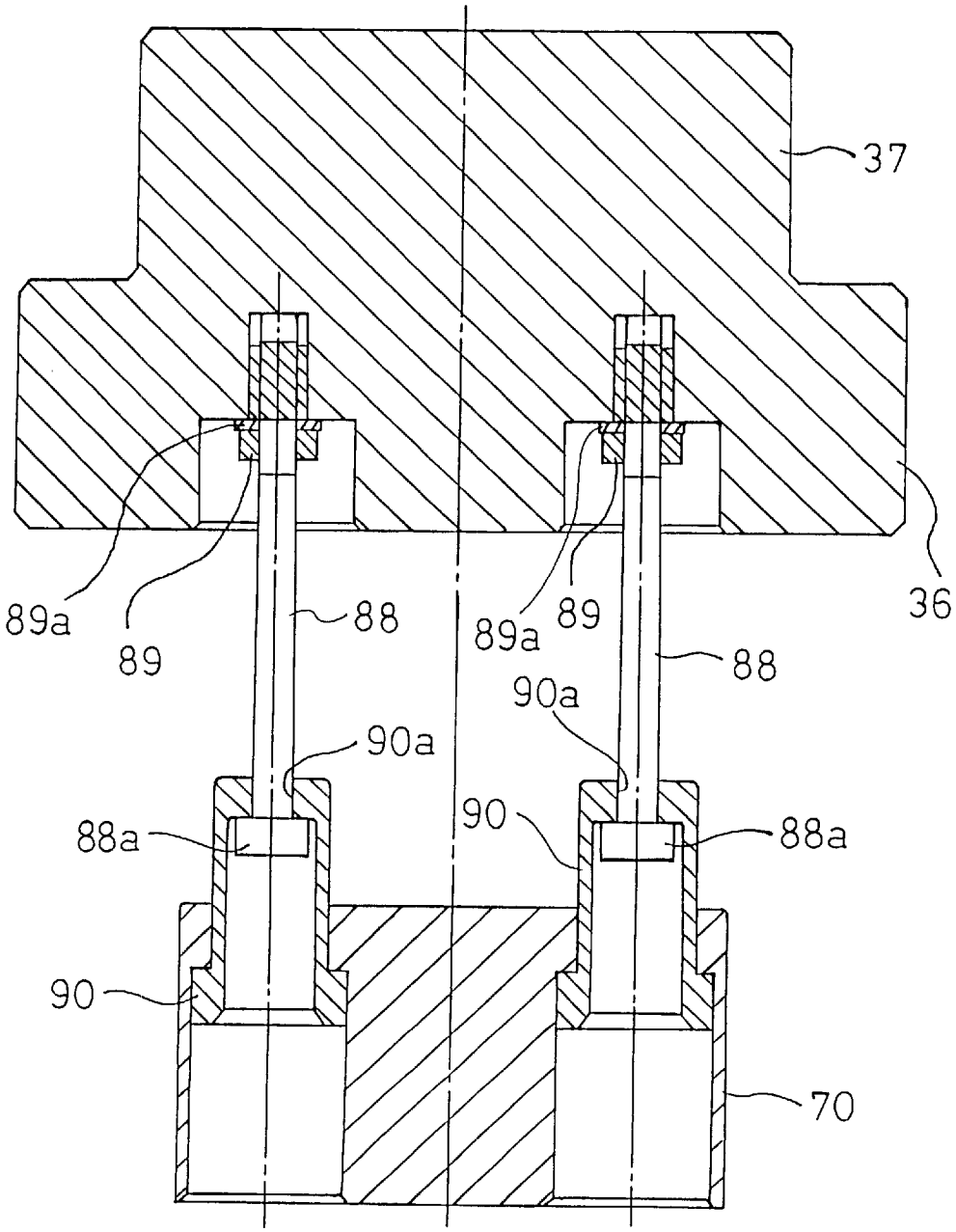
FIG. 12 is a section view taken along the line F—F of FIG. 11.

As shown in FIG. 12, the air supply/discharge valve control plate 70 and the valve case 37 are coupled to each other by one, or preferably plural guide shafts 88 which are parallel to the extending and contracting directions of the diaphragm 29. In each of the guide shafts 88, the front end portion is fasteningly fixed to the rear end face of the valve case 37 by a nut 89 via a washer 89*a*, and the rear end portion having a flange 88*a* is coupled to a guide sleeve 90 which is embeddedly fixed to the front end face of the air supply/discharge valve control plate 70, so as to be prevented from slipping off, and slidable in the axial direction. In the front end portion of each of the guide sleeves 90, a guide hole portion 90*a* which is slidingly contacted with the corresponding guide shaft 88 without leaving a substantial gap therebetween is formed. The rear end portions of the guide shafts 88 are passed through the guide hole portions 90*a*, thereby enabling the air supply/discharge valve control plate 70 to be straightly moved in parallel with the extending and contracting directions of the diaphragm 29 under guidance of the guide shafts 88.

The guide sleeves 90 may be formed integrally with the air supply/discharge valve control plate 70.

Next, the operation of the thus configured automatic air supply/discharge valve mechanisms 41 and 42 will be described.

Figure 16A:
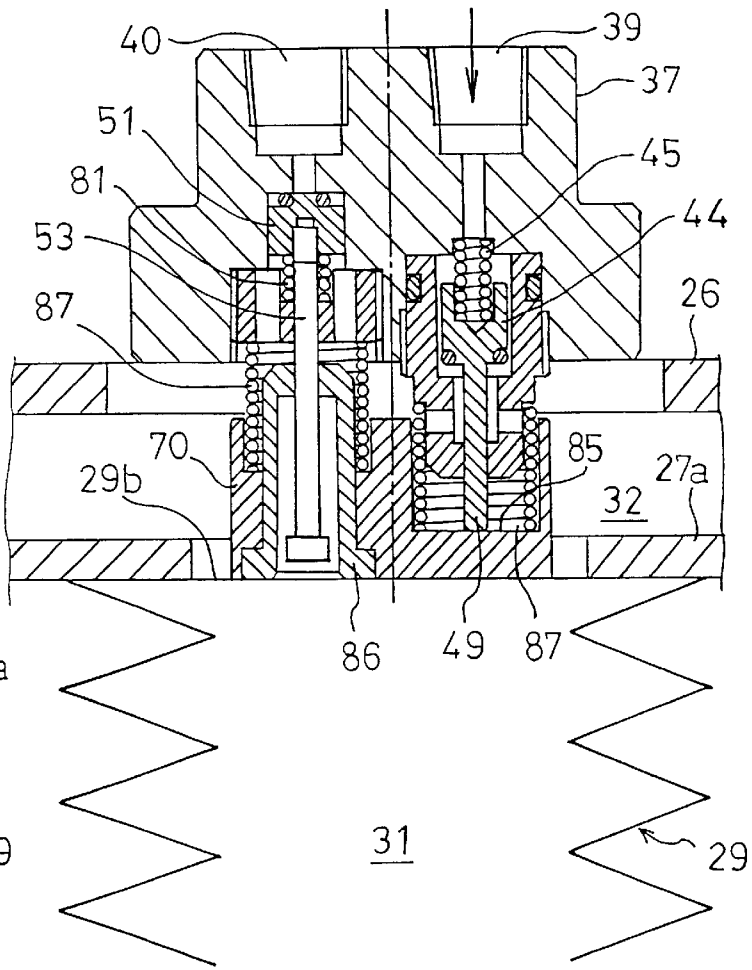
FIG. 16A is an operation diagram of the air supply valve and the air discharge valve of the automatic pressure adjusting mechanism in the case where the fluid pressure in the bellows of the accumulator is raised.
Figure 16B:
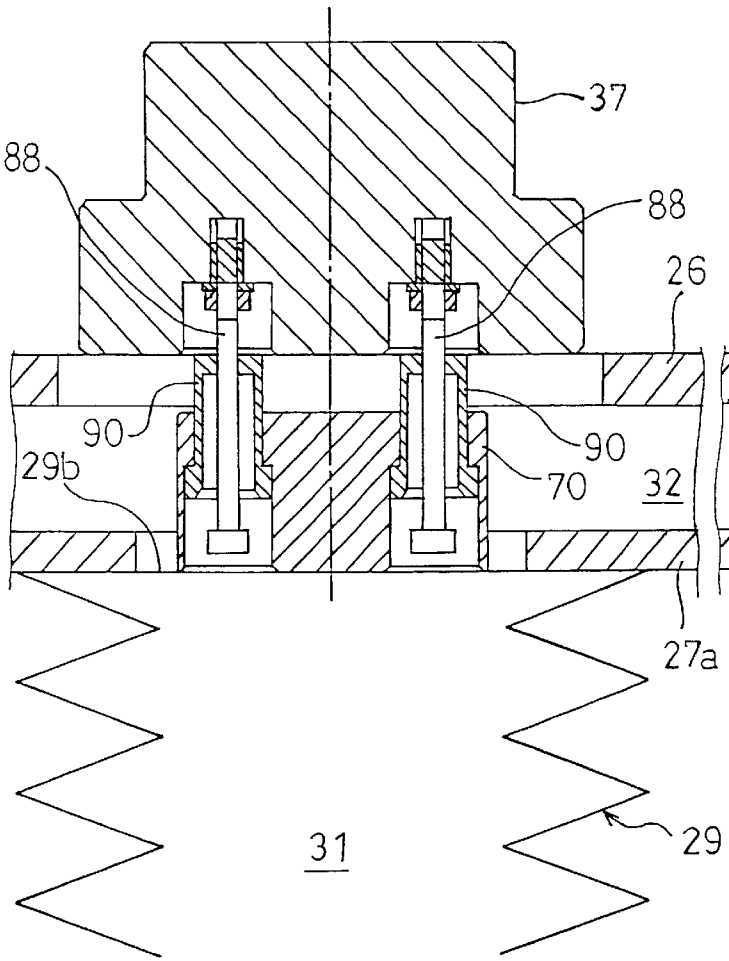
FIG. 16B is an operation diagram of a guide shaft and a guide sleeve of the automatic pressure adjusting mechanism in the case where the fluid pressure in the bellows of the accumulator is raised.

When the discharge pressure of the reciprocating pump P is varied in the increasing direction, the capacity of the liquid chamber 31 is increased by the transported liquid, and the fluid pressure in the liquid chamber 31 overcomes the pressure in the air chamber 32, so that the diaphragm 29 is extendingly deformed. As shown in FIGS. 16A and 16B, this extending deformation of the diaphragm 29 causes the air supply/discharge valve control plate 70 to be pushed by the center area of the closed upper end portion 29*b* of the diaphragm 29 toward the valve case 37. As a result, the rear end portion of the air supply valve rod 49 is pushed by the air supply valve rod pressing portion 85 of the air supply/discharge valve control plate 70, whereby the air supply valve element 44 which has been set to the closing state by the spring 45 is changed to the opening state. Therefore, the compressed air is supplied into the air chamber 32 through the air supply port 39 to raise the filling pressure in the air chamber 32. In accordance with the rise of the filling pressure in the air chamber 32, the diaphragm 29 is contracted. Then, the air supply valve rod pressing portion 85 of the air supply/discharge valve control plate 70 does not push the rear end portion of the air supply valve rod 49, and the air supply valve element 44 is set to the closing state by the spring 45 and the compressed air in the air chamber 32, so as to balance with the fluid pressure in the liquid chamber 31. When the diaphragm 29 is extended by a degree which is greater than the predetermined stroke, the closed upper end portion 29*b* of the diaphragm strikes against a stopper wall 27*a* of the casing 27 of the accumulator A which protrudes into the air chamber 32, whereby excessive extending deformation of the diaphragm 29 is restricted, so that the diaphragm can be prevented from being damaged.

Figure 17A:
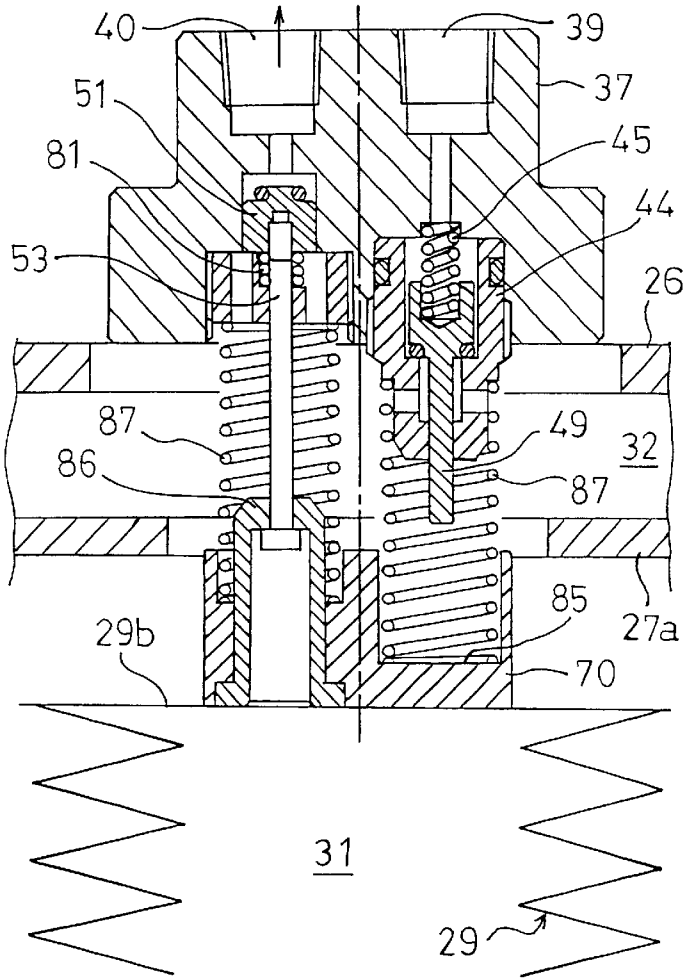
FIG. 17A is an operation diagram of the air supply valve and the air discharge valve of the automatic pressure adjusting mechanism in the case where the fluid pressure in the bellows of the accumulator is lowered.
Figure 17B:
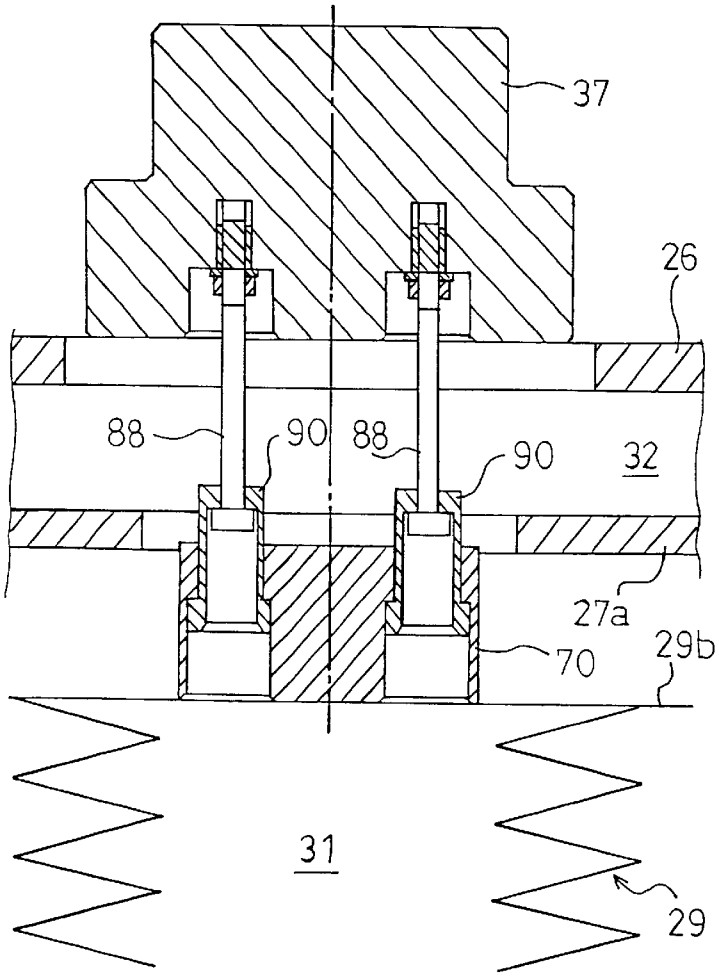
FIG. 17B is an operation diagram of the guide shaft and the guide sleeve of the automatic pressure adjusting mechanism in the case where the fluid pressure in the bellows of the accumulator is lowered.

By contrast, when the discharge pressure of the reciprocating pump P is varied in the decreasing direction, the capacity of the liquid chamber 31 is reduced by the transported liquid, and the pressure in the air chamber 32 overcomes the fluid pressure in the liquid chamber 31, so that the diaphragm 29 is contractingly deformed. As shown in FIGS. 17A and 17B, this contracting deformation of the diaphragm 29 causes the air supply/discharge valve control plate 70 to, in accordance with the movement of the closed upper end portion 29*b* of the diaphragm 29 in the contracting direction, be moved in the same direction while receiving the urging force of the springs 87. The air discharge valve rod 53 which is coupled to the discharge valve rod pulling portion 86 of the air supply/discharge valve control plate 70 is pulled in the same direction, whereby the air discharge valve element 51 is changed to the opening state. Therefore, the compressed air in the air chamber 32 is discharged to the atmosphere from the air discharge port 40 to lower the filling pressure in the air chamber 32. In accordance with the reduction of the filling pressure in the air chamber 32, the diaphragm 29 is extended. Then, the air supply/discharge valve control plate 70 is pushed by the center area of the closed upper end portion 29*b* of the diaphragm 29, and the air discharge valve element 51 is caused to close the air discharge port 40 by the urging action of the spring 81. As a result, the filling pressure in the air chamber 32 is fixed to the adjusted state.

As described above, when a fluid pressure is applied into the diaphragm 29, the compressed air is sucked or discharged until balance with the pressure is attained, whereby pulsations are efficiently absorbed and the amplitude of pulsations is suppressed to a low level, irrespective of variation of the discharge pressure of the reciprocating pump P.

In this way, the air supply valve element 44 and the air discharge valve element 51 which are separately and independently disposed in the valve case 37 are subjected to the valve-opening control in accordance with expansion and contraction of the diaphragm 29, via the air supply valve rod pressing portion 85 and the air discharge valve rod pulling portion 86 on the air supply/discharge valve control plate 70. Since the air supply/discharge valve control plate 70 is placed so as to always abut against the center area of the closed upper end portion 29*b* of the diaphragm 29, no offset load is applied to the diaphragm 29 even when the air supply valve element 44 and the air discharge valve element 51 are juxtaposed separately and independently in the valve case 37. Therefore, the diaphragm 29 is always straightly extendingly and contractingly deformed in the axial direction X—X of the valve case 37, whereby the responsibility of the opening and closing operations of the air supply and discharge valve elements 44 and 51 can be improved and the performance of reducing pulsations can be ensured. The air supply/discharge valve control plate 70 can be always enabled to be moved in parallel stably and surely by the guiding action of the guide shafts 88. Consequently, the air supply and discharge valve elements 44 and 51 can faithfully perform the opening and closing operations corresponding to expansion and contraction of the diaphragm 29, via the air supply/discharge valve control plate 70.

In the accumulator A of the above-described embodiment, the automatic pressure adjusting mechanism consisting of the automatic air supply valve mechanism 41 and the automatic air discharge valve mechanism 42 is attached to the air chamber 32. The air chamber 32 is required only to have the opening 35 for allowing air to inflow and outflow, and is not always requested to have the automatic pressure adjusting mechanism. The pressure adjustment may be manually performed.

When, in the reciprocating pump P, the suction port 18 is formed in the side face of the protruding tip end portion of the suction check valve 20 so as to eject sucked liquid to the circumferential wall 9*a* in the liquid chamber 9 and in the direction different from the direction of the axis B as in the embodiment, the liquid ejected into the liquid chamber 9, particularly, also liquid containing a sedimenting material such as slurry flows while swirling along the circumferential wall 9*a*, and does not stay on the circumferential wall 9*a* in the liquid chamber 9, particularly in the embodiment, the extending and contracting portion of the diaphragm 7 configured by a bellows, thereby exerting a function of being always replaced with fresh liquid. In the accumulator A also, since the inflow port 23 is formed in the side face of the protruding tip end portion of the discharge check valve 21 so as to eject liquid to the circumferential wall 31*a* which is in the liquid chamber 31 and in the direction different from the direction of the axis C, liquid ejected into the liquid chamber 31 flows while swirling along the circumferential wall 31*a* and is always replaced with fresh liquid without causing staying.

Figure 18:
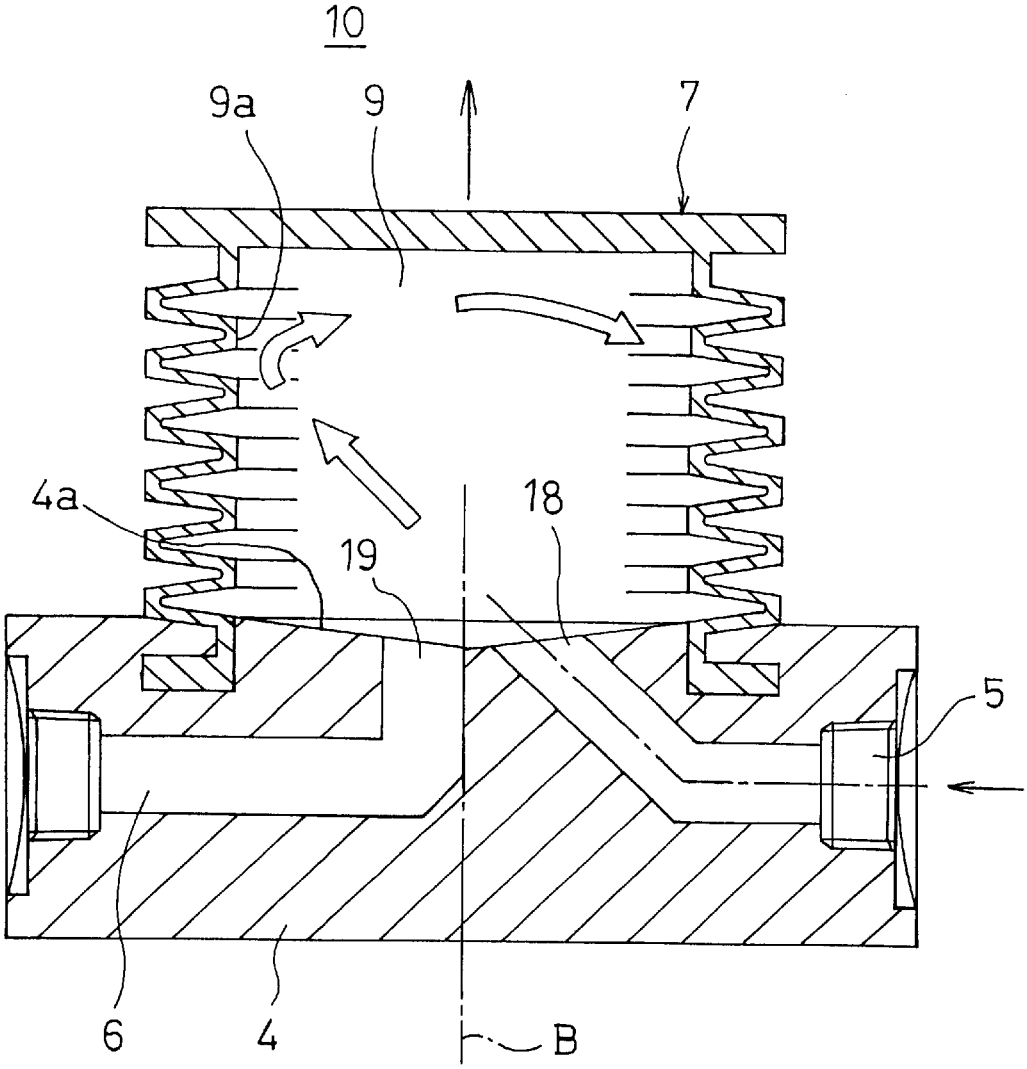
FIG. 18 is a section view of main portions of a reciprocating pump showing another embodiment.

According to the embodiment, in the reciprocating pump P, the suction port 18 is formed in the side face of the protruding tip end portion of the suction check valve 20. Alternatively, as shown in FIG. 18, the suction port 18 may be opened obliquely upward in the inner wall 4*a* itself of the pump body 1 so as to eject liquid toward the circumferential wall 9*a* in the liquid chamber 9. In the accumulator A also, the outflow port 23 may not be formed in the side face of the protruding tip end portion of the discharge check valve 21, and may be opened obliquely upward in the inner wall 28*a* itself of the accumulator body 25 so as to eject liquid toward the circumferential wall 31*a* in the liquid chamber 31.

In the embodiment, the diaphragm 7 of the reciprocating pump P and the diaphragm 29 of the accumulator A are disposed with setting their respective axes B and C vertical (perpendicular). Even in the case where liquid containing a sedimenting material such as slurry is used, therefore, staying of the sedimenting material in the extending and contracting portions of the bellows 7 and 29 can be reduced as far as possible. The diaphragms are not restricted to them. The reciprocating pump P and the accumulator A may be configured so that the diaphragm 7 of the reciprocating pump P and the diaphragm 29 of the accumulator A are disposed with setting their respective axes B and C lateral (horizontal).

Each of the suction check valve 20 and the discharge check valve 21 of the reciprocating pump P employs the own-weight closing mechanism which does not use a spring for urging a ball, and in which the valve casing 201 or 220 is set to be vertical, and the ball valve elements 202 or 221 are caused by their own weight to be closely contacted with the valve seat 211 (213) or 230 (232) in the valve casing 201 or 220, thereby preventing liquid from reversely flowing. This is advantageous because, even in the case where liquid containing a sedimenting material such as slurry is used, the sedimenting material can be prevented from staying and aggregating inside the respective check valves 20 and 21. The valves are not restricted to them. The suction check valve 20 and the discharge check valve 21 may have a mechanism which uses a spring for urging a ball.

Each of the suction check valve 20 and the discharge check valve 21 comprises the ball valve elements 202 or 221 vertically arranged in two stages to constitute a double closing structure as in the embodiment. This structure is advantageous because quantitative supply of the transported liquid can be ensured. Each of the valve casings 201 and 220 is configured by the first valve casing 201*a* or 220*a* and the second valve casing 201*b* or 220*b* which are vertically separated so as to facilitate incorporation of the ball valve elements 202 or 221 into two vertical stages. However, the valves are not restricted to such a configuration, and may have a single ball valve element 202 or 221, and each of the valve casings 201 and 220 may be configured into a single body (see FIG. 4).

In the reciprocating pump P, when the inner wall 4*a* of the liquid chamber 9 is formed into a shape in which the wall is downward inclined as moving toward the discharge port 19, also liquid containing a sedimenting material such as slurry can be smoothly discharged along the downward inclined face of the inner wall 4*a* toward the discharge port 19. This is advantageous to prevent the sedimenting material from collecting and setting on the inner wall 4*a*. Alternatively, the inner wall 4*a* may be flat. In the accumulator A, similarly, since the inner wall 28*a* of the liquid chamber 31 is formed into a shape in which the wall is downward inclined as moving toward the outflow port 24, also liquid containing a sedimenting material such as slurry can be smoothly discharged along the downward inclined face of the inner wall 28*a* toward the outflow port 24. This can prevent the sedimenting material from collecting and setting on the inner wall 28*a*. Alternatively, the inner wall 28*a* may be flat.

In the reciprocating pump P, the extending and contracting portion of the diaphragm 7 which is configured by forming the ridge-like folds 71 and the valley-like folds 72 in a vertically alternate and continuous manner is formed into a shape in which the lower one of the upper and lower lamella portions 71*a* and 71*b* of each of the ridge-like folds 71, or the lower lamella portion 71*b* is downward inclined as moving toward the axis B, not only in an extending state but also in a contracting state. Even in the case where transported liquid containing a sedimenting material such as slurry is used as transported liquid, therefore, the sedimenting material in the diaphragm 7 easily slips down along the downward inclined face of the inner face of the lower lamella portion 71*b* of each of the ridge-like folds 71, and does not stagnate and collect on the inner face of the lower lamella portion 71*b*, whereby, in cooperation with prevention of staying of sediment on the conical inner wall 4*a*, sedimenting and aggregation of sediment in the reciprocating pump P can be prevented more effectively from occurring. In the accumulator A, similarly, even in the case where liquid containing a sedimenting material such as slurry is used as transported liquid, the sedimenting material in the diaphragm 29 easily slips down along the downward inclined face of the inner face of the lower lamella portion 291*b* of each of the ridge-like folds 291, and does not stagnate and collect on the inner face of the lower lamella portion 291*b*, whereby, in cooperation with prevention of staying of sediment on the conical inner wall 28*a*, sedimenting and aggregation of sediment in the accumulator A can be prevented more effectively from occurring. However, the diaphragms are not restricted to the diaphragms 7 and 29 having such a shape. The diaphragms 7 and 29 are not restricted to bellows, and the invention can be applied also to an apparatus configured by diaphragms.

Figure 19:
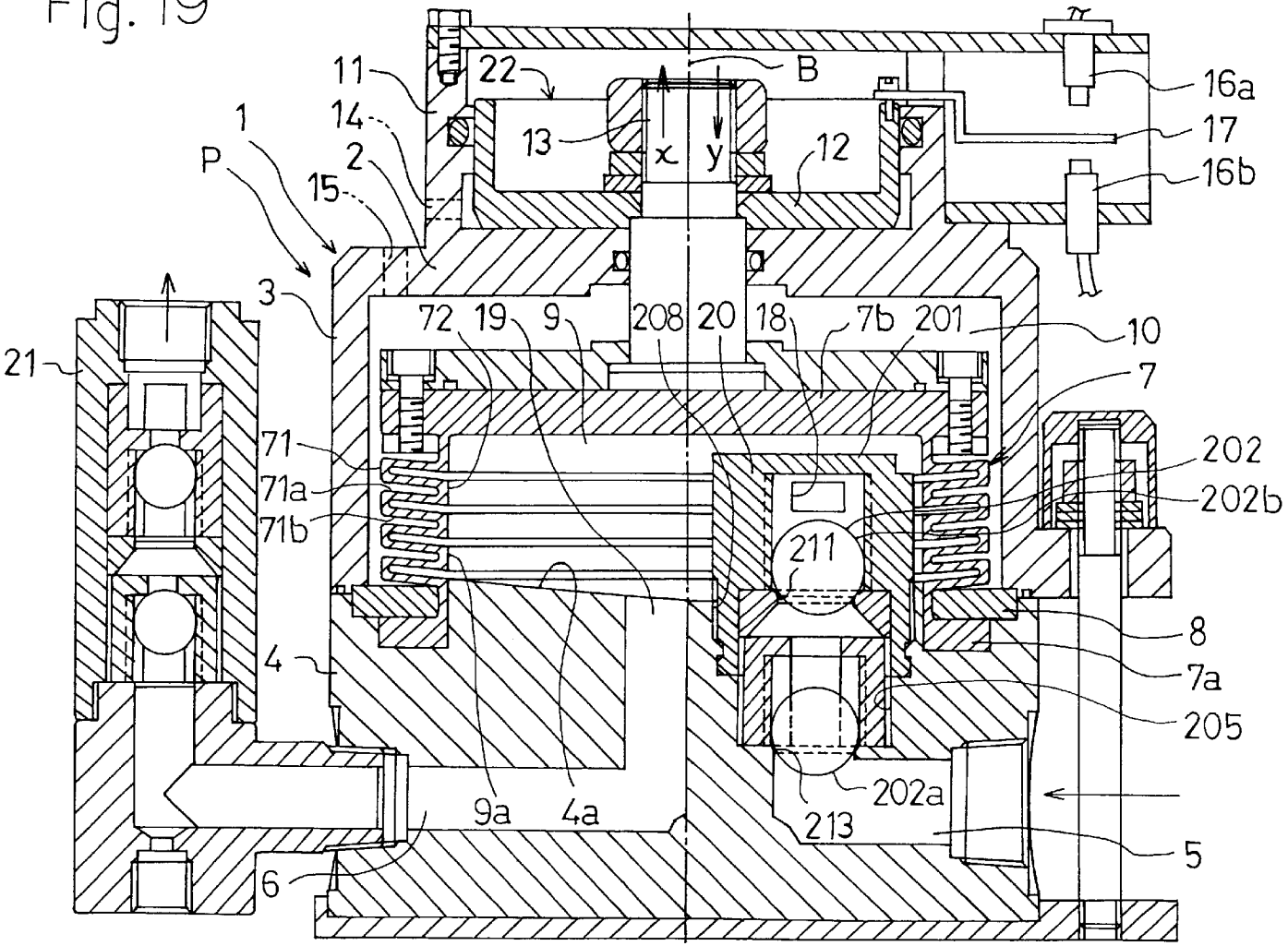
FIG. 19 is a longitudinal sectional front overall view of a reciprocating pump showing a further embodiment.

It is a matter of course that the fluid apparatus of the invention is not restricted to an apparatus in which the reciprocating pump P and the accumulator A for preventing pulsations of the pump are juxtaposed as in the embodiment, and may be similarly applied to an apparatus which is configured only by the reciprocating pump P as shown in FIG. 19. In this case, the apparatus is identical with the configuration of the above-mentioned reciprocating pump P except that the apparatus is configured singly by a double acting pump P and the discharge check valve 21 is externally attached to the downstream end of the discharge passage 6. Therefore, the identical components are denoted by the same reference numerals, and their description is omitted. Furthermore, the invention is not restricted to liquid containing a sedimenting material such as slurry, and may be applied also to ultrapure water of high purity, chemical liquid, and the like which are not to be stayed.

INDUSTRIAL APPLICABILITY

According to the invention, in a reciprocating pump or an accumulator, since liquid ejected from a suction port or an inflow port produces a swirling flow along a circular wall of a liquid chamber and the interior of the liquid chamber is stirred by the swirling flow, staying of the liquid in the liquid chamber is eliminated to enable fresh liquid to be always supplied, and, even in the case where liquid containing a sedimenting material such as slurry is used, the sedimenting material can be prevented from sedimenting and aggregating in the liquid chamber.

What is claimed:

1. A fluid apparatus configured by a reciprocating pump in which a diaphragm that reciprocally moves in an axial direction, such as a bellows or a diaphragm is disposed in a pump body so as to form a liquid chamber with respect to an inner wall of said pump body, a suction port and a discharge port are disposed in said inner wall of said pump body facing said liquid chamber, and a stroke of sucking liquid from said suction port into said liquid chamber, and a stroke of discharging the liquid in said liquid chamber from said discharge port are alternately performed by reciprocal motion of said diaphragm, wherein said suction port is disposed so as to eject the sucked liquid toward a circumferential wall which is in said liquid chamber and in a direction different from the axial direction.

2. A fluid apparatus according to claim 1, wherein said suction port is disposed in a side face of a protruding tip end portion of a suction check valve which is fixed so as to protrude into said liquid chamber from said inner wall of said pump body facing said liquid chamber.

3. A fluid apparatus according to claim 1, wherein said inner wall of said liquid chamber of said pump body is formed into a shape in which said wall is downward inclined as moving toward said discharge port.

4. A fluid apparatus configured by an accumulator in which a diaphragm that reciprocally moves in an axial direction, such as a bellows or a diaphragm is disposed in an accumulator body so as to form a liquid chamber inside said diaphragm and an air chamber outside said diaphragm, an inflow port and an outflow port are disposed in an inner wall of said accumulator body facing said liquid chamber, and a liquid pressure in said liquid chamber balances with an air pressure in said air chamber, wherein said inflow port is disposed so as to eject inflowing liquid toward a circumferential wall which is in said liquid chamber and in a direction different from the axial direction.

5. A fluid apparatus according to claim 3, wherein said inflow port is disposed in a side face of a protruding tip end portion of a discharge check valve which is fixed so as to protrude into said liquid chamber from said inner wall of said accumulator body facing said liquid chamber.

6. A fluid apparatus according to claim 3, wherein said inner wall of said liquid chamber of said accumulator body is formed into a shape in which said wall is downward inclined as moving toward said outflow port.

* * * * *